US008757421B2

(12) United States Patent
Yang et al.

(10) Patent No.: US 8,757,421 B2
(45) Date of Patent: Jun. 24, 2014

(54) BEVERAGE PACKAGING AND METHOD OF MANUFACTURE

(75) Inventors: Darlene Yang, Seattle, WA (US); Mary Jo Werlein, Fall City, WA (US)

(73) Assignee: Starbucks Corporation, Seattle, WA (US)

( * ) Notice: Subject to any disclaimer, the term of this patent is extended or adjusted under 35 U.S.C. 154(b) by 569 days.

(21) Appl. No.: 13/027,103

(22) Filed: Feb. 14, 2011

(65) Prior Publication Data

US 2012/0205376 A1 Aug. 16, 2012

(51) Int. Cl.

| | |
|---|---|
| ***B65D 69/00*** | (2006.01) |
| ***B65D 71/00*** | (2006.01) |
| ***B65D 51/00*** | (2006.01) |
| ***B65D 51/20*** | (2006.01) |
| ***B65D 1/24*** | (2006.01) |
| ***B65D 1/36*** | (2006.01) |
| ***B65D 25/04*** | (2006.01) |
| ***B65D 57/00*** | (2006.01) |
| ***B65D 85/00*** | (2006.01) |
| ***B65D 39/00*** | (2006.01) |
| ***B65D 41/00*** | (2006.01) |
| ***B65D 43/00*** | (2006.01) |
| ***B65D 47/00*** | (2006.01) |

(52) U.S. Cl.

USPC ..... 220/521; 220/212; 220/258.5; 215/227; 215/246; 206/223

(58) Field of Classification Search

USPC ..... 220/521, 258.5; 215/227, 246

See application file for complete search history.

(56) References Cited

U.S. PATENT DOCUMENTS

| | | | | |
|---|---|---|---|---|
| 1,743,980 | A * | 1/1930 | Meyer | 220/214 |
| 2,963,194 | A | 2/1958 | Brennan et al. | |
| 3,381,876 | A * | 5/1968 | Biggins | 220/574 |
| 3,506,459 | A | 4/1970 | Parlour | |
| 3,955,742 | A * | 5/1976 | Marshall et al. | 220/574 |
| 4,522,298 | A | 6/1985 | Weinberger | |

(Continued)

FOREIGN PATENT DOCUMENTS

| | | |
|---|---|---|
| CH | 381 606 | 8/1964 |
| DE | 201 03 746 | 2/2002 |

(Continued)

OTHER PUBLICATIONS

International Search Report and Written Opinion for PCT Application No. PCT/US2012/023399, filed Jan. 31, 2012, dated Jul. 30, 2012.

*Primary Examiner* — Fenn Mathew
*Assistant Examiner* — Andrew T Kirsch
(74) *Attorney, Agent, or Firm* — Knobbe Martens Olson & Bear LLP

(57) ABSTRACT

Disclosed are packages for serving and storing powdered beverages and associated methods. A package for storing a powdered instant beverage comprises a first container, a utensil, and a lid. The lid is configured to engage with the first container so that the lid and the container enclose an interior volume. The lid comprises a lid body, a lid insert configured to be secured to the lid body, and a utensil-holding structure on the lid insert. The lid insert comprises a utensil recess configured to receive at least a portion of the utensil, and a handling recess configured to facilitate the removal and securing of the utensil to the lid. The utensil-holding structure is configured to removably secure the utensil to the lid insert.

42 Claims, 15 Drawing Sheets

(56) References Cited

U.S. PATENT DOCUMENTS

| | | | | |
|---|---|---|---|---|
| 4,883,935 | A | 11/1989 | Fairchild et al. | |
| 5,251,758 | A * | 10/1993 | Kolacek | 206/542 |
| 5,251,774 | A | 10/1993 | Engle | |
| 5,415,309 | A * | 5/1995 | Wang | 220/4.27 |
| 5,447,236 | A | 9/1995 | Perry et al. | |
| 5,705,212 | A * | 1/1998 | Atkinson | 426/115 |
| 5,706,974 | A | 1/1998 | Murdick et al. | |
| 5,749,460 | A | 5/1998 | Rice | |
| 5,775,531 | A | 7/1998 | Lowry | |
| 6,199,699 | B1 | 3/2001 | Eastman | |
| 6,352,170 | B1 * | 3/2002 | Brown et al. | 220/782 |
| 6,528,105 | B1 | 3/2003 | Gerhart et al. | |
| 6,604,645 | B1 | 8/2003 | Vaupotic | |
| 6,641,854 | B2 | 11/2003 | Gerhart et al. | |
| 6,766,902 | B1 * | 7/2004 | Hartelius | 206/217 |
| 7,175,041 | B2 | 2/2007 | Ekkert | |
| 7,464,475 | B2 | 12/2008 | Tsao | |
| 2002/0110622 | A1 | 8/2002 | Lloyd et al. | |
| 2002/0114870 | A1 | 8/2002 | Rebhorn et al. | |
| 2003/0029868 | A1 | 2/2003 | Davidov et al. | |
| 2005/0115965 | A1 | 6/2005 | Gibson | |
| 2005/0178677 | A1 | 8/2005 | Morrow | |
| 2005/0247585 | A1 * | 11/2005 | Breckwoldt et al. | 206/350 |
| 2007/0029215 | A1 | 2/2007 | Martinez | |
| 2008/0149637 | A1 | 6/2008 | Hanafusa | |
| 2008/0156806 | A1 | 7/2008 | Perry et al. | |
| 2008/0156808 | A1 * | 7/2008 | Perry et al. | 220/560.03 |
| 2009/0120942 | A1 | 5/2009 | Vovan | |
| 2009/0184120 | A1 | 7/2009 | Stevens | |
| 2009/0277902 | A1 | 11/2009 | Darflinger | |
| 2010/0051631 | A1 | 3/2010 | Blomdahl et al. | |
| 2011/0284554 | A1 | 11/2011 | Ray et al. | |

FOREIGN PATENT DOCUMENTS

| | | |
|---|---|---|
| FR | 2831524 | 5/2003 |
| JP | 53 025835 | 3/1978 |
| WO | WO 96/07604 | 3/1996 |

* cited by examiner

BEVERAGE PACKAGING AND METHOD OF MANUFACTURE

BACKGROUND

1. Field

The present disclosure generally relates to packages for serving and storing powdered beverages, such as instant coffee and tea, as well as associated methods for packaging powdered beverages.

2. Description of the Related Art

Packages for storing powdered beverages, such as instant coffee and tea, are known in the art. However, it is difficult to provide a package for a powdered instant beverage that is simple, inexpensive, and convenient to serve, store, and manufacture.

SUMMARY

One embodiment provides a package for storing a powdered instant beverage. The package comprises a first container, a utensil, and a lid. The lid is configured to engage the first container so that the lid and the container enclose an interior volume. The lid comprises a lid body, a lid insert, and a utensil-holding structure. The lid insert is configured to be secured to the lid body. The lid insert comprises a utensil recess configured to receive at least a portion of the utensil, and a handling recess configured to facilitate the removal and securing of the utensil to the lid. The utensil-holding structure is on the lid insert. The utensil-holding structure is configured to removably secure the utensil to the lid insert. In some embodiments, the package comprises a removable membrane configured to seal an upper end of the first container.

A further embodiment provides a package for storing and serving a powdered instant beverage. The package comprises first and second containers, a lid, a utensil, and a securing strip. The first container comprises a rim extending around an opening positioned at an upper end of the first container. The second container has a lower end configured to be inserted into the opening of the first container. The second container comprises a rim-engaging structure extending outwardly from a sidewall of the second container, the rim-engaging structure configured to contact and rest upon the rim when the lower end of the second container is inserted into the opening of the first container. The lid is configured to engage the second container so that the lid and the second container enclose an interior volume. At least one of the lid and the utensil comprises a utensil-holding structure configured to removably secure the utensil to the lid. The securing strip is configured to engage with at least two of the first container, the second container and the lid when the lower end of the second container is inserted into the opening of the first container and the rim-engaging structure rests upon the rim.

Another embodiment provides a method of packaging a powdered instant beverage. The method comprises providing a first container comprising a rim extending around an opening positioned at an upper end of the first container. A second container is filled with a powdered instant beverage, the second container comprising a sidewall with a rim-engaging structure extending outwardly therefrom. A utensil is removably secured to a lid. The second container is engaged with the lid so that the lid and the second container enclose an interior volume. A lower end of the second container is inserted into the opening of the first container such that the rim-engaging structure of the second container contacts the rim of the first container. A securing strip is engaged with at least two of the first container, the second container and the lid when the lower end of the second container is inserted into the opening of the first container and the rim-engaging structure rests upon the rim.

Another embodiment provides a package for storing and serving a powdered instant beverage. The package comprises first and second containers, a lid, a utensil, and a securing strip. The first container has an open upper end and comprises an upper portion and a lower portion. The second container has a lower portion configured to be inserted into the open upper end of the first container. The upper portion of the first container is sized and shaped to receive the lower portion of the second container. The lower portion of the first container is sized and shaped to inhibit insertion of the lower portion of the second container into the lower portion of the first container, such that the second container can rest within and upon the first container when the lower portion of the second container is inserted into the upper portion of the first container. The lid is configured to engage an open upper end of the second container so that the lid and the second container enclose an interior space. At least one of the lid and the utensil comprises a utensil-holding structure configured to removably hold the utensil to the lid. The securing strip is configured to engage with at least two of the first container, the second container and the lid when the lower portion of the second container is inserted into the upper portion of the first container and the second container rests within and upon the first container.

For purposes of summarizing the invention and the advantages achieved over the prior art, certain objects and advantages of the invention have been described above and as further described below. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

FIG. 2 shows a front and top perspective view of the package shown in

FIG. 1.

DETAILED DESCRIPTION

Although preferred embodiments will be discussed below in terms of packages for storing and serving powdered beverages such as instant coffee and tea, it will be understood that the invention can also be employed with other types of products, including other types of solid, semi-solid and/or liquid food or non-food products.

Figure 1:
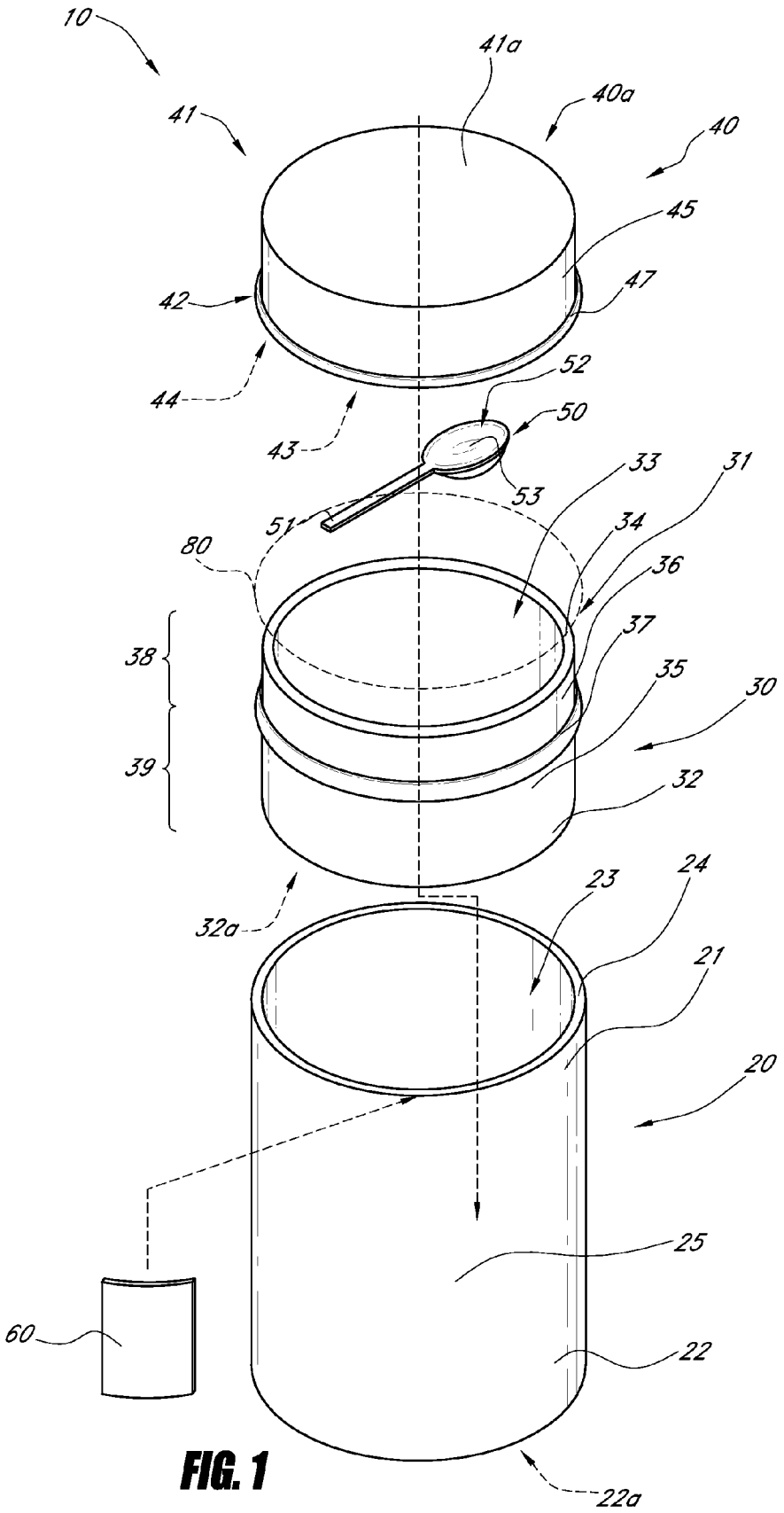
FIG. 1 shows a front and top exploded perspective view of an embodiment of a package for storing and serving a powdered instant beverage.
Figure 2:
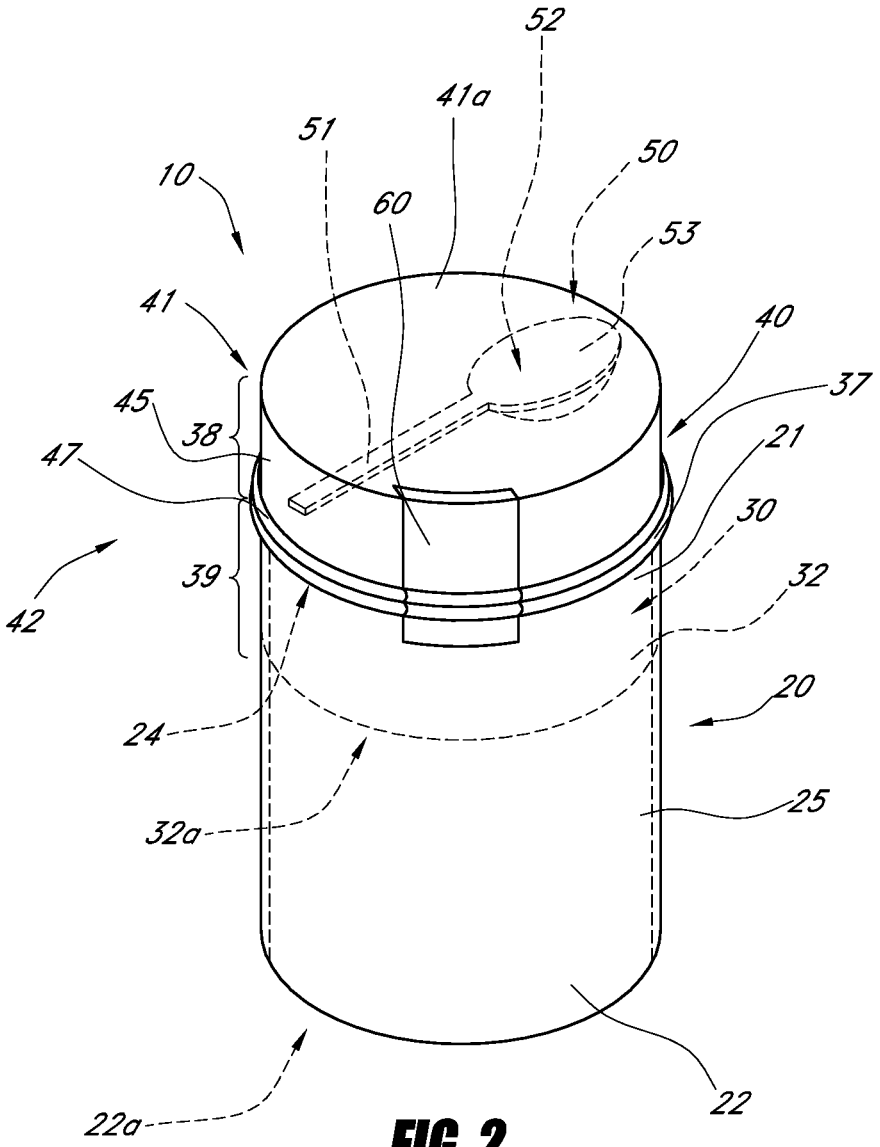

FIG. 1 shows a front and top exploded perspective view of an embodiment of a package 10 for storing and serving a material (e.g., a powdered or granulated food or beverage product, such as instant coffee or tea). FIG. 2 shows a front and top perspective view of the package 10 shown in FIG. 1.

Referring to FIGS. 1 and 2, package 10 can comprise a first container 20 configured to be packaged in combination with a second container 30, a lid 40, and a utensil 50. In some embodiments, second container 30 can be configured to be inserted into first container 20. In some embodiments, lid 40 can be configured to engage second container 30 to enclose an interior volume within second container 30. In some embodiments, utensil 50 can be configured to be removably held to the lid 40. In some embodiments, package 10 can further comprise a securing strip 60 configured to engage with at least two of the first container 20, the second container 30 and the lid 40, as described further herein.

First container 20 can comprise any of many shapes and materials capable of receiving, storing, and/or serving a material, preferably a liquid, and even more preferably, a liquid for human or animal consumption, such as water, coffee, and the like. First container 20 can comprise one or more sidewalls, illustrated here as a sidewall 25, extending between an upper end 21 and a lower end 22 of first container 20. At least one of upper end 21 and lower end 22 can be closed (e.g., with a separate (e.g., removable) or integral cover or lid), to form an internal volume within container 20. In the illustrative embodiment, the lower end 22 of first container 20 is closed (e.g., covered) with a base 22*a*. It will be understood that the positioning of base 22*a* or a similar structure is not limited to an uppermost or lowermost extremity of first container 20; base 22*a* can be positioned anywhere within an inner perimeter of sidewall 25 that closes or covers first container 20 to form an internal volume within container 20. At least one of upper end 21 and lower end 22 can be open, to facilitate the insertion of material (e.g., a liquid, or a liquid mixed with a powdered beverage) or other objects (e.g., a portion of second container 30) into first container 20. In the illustrated embodiment, first container 20 comprises an opening 23 positioned at upper end 21, to facilitate the insertion of some, most or all of second container 30 into first container 20. A rim 24 can extend around the opening 23 of upper end 21. Rim 24 can be configured to contact a portion of second container 30 (FIG. 2) when second container 30 is inserted into first container 20, as described further herein.

Figure 3:
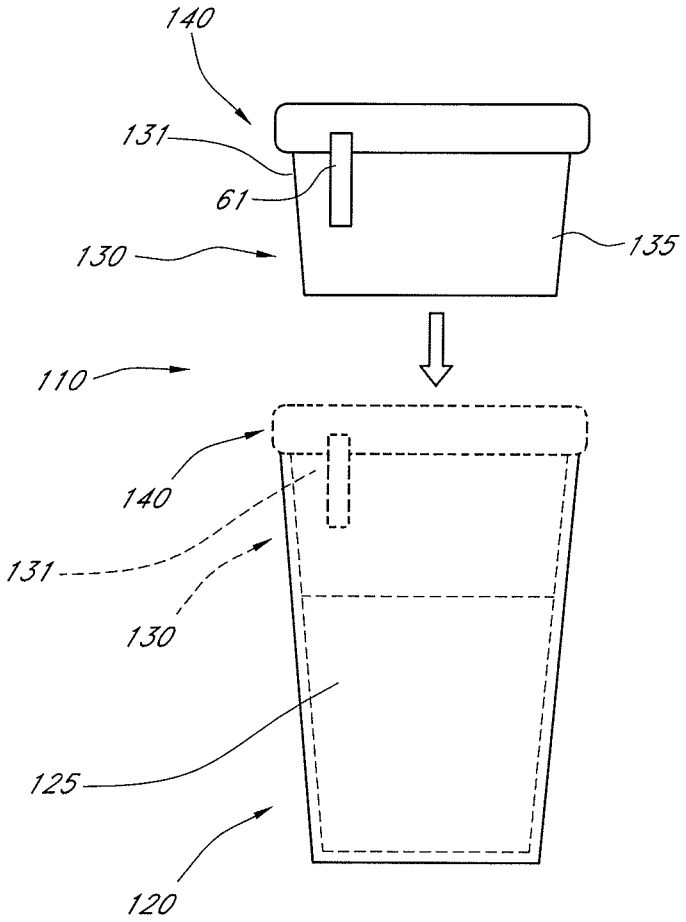
FIG. 3 shows a front elevational view of another embodiment of a package for storing and serving a powdered instant beverage.
Figure 4A:
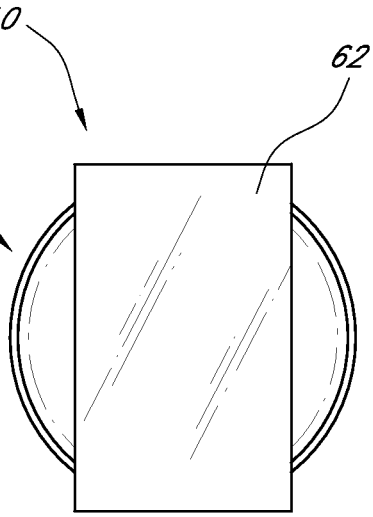
FIG. 4A shows a top view of an embodiment of the package shown in FIG. 3, with a securing strip that forms a loop.
Figure 4B:
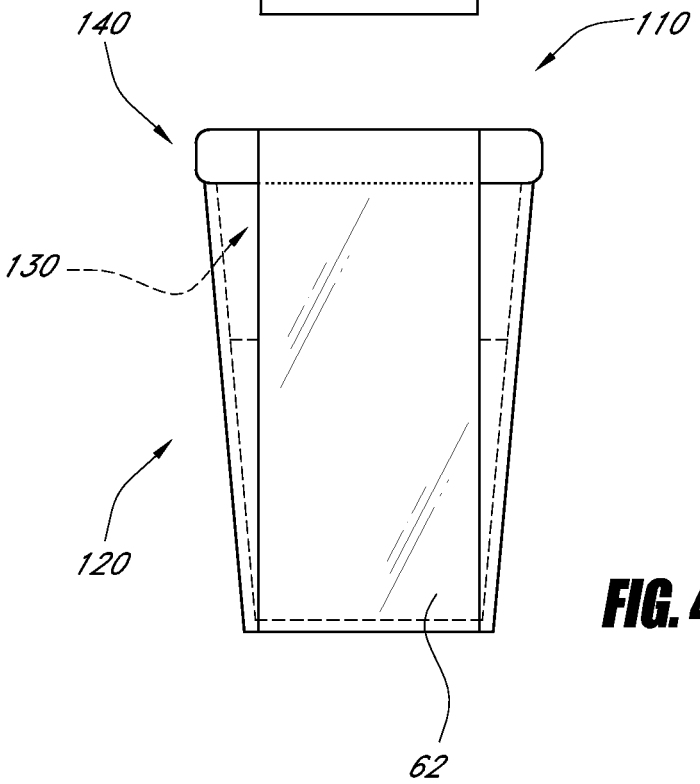
FIG. 4B shows a front elevational view of the package shown in FIG. 4A.

First container 20 can comprise any of many different cross-sectional shapes, such as an approximately rectangular, elliptical, trapezoidal, or any other regular or irregular shape that forms a hollowed, inner volume when extended longitudinally, to hold material and receive second container 30. The inner volume of first container 20 can be the same or a different shape relative to the overall outer shape formed by the outer surfaces of first container 20. The vertical longitudinal cross-section of the illustrated first container 20 has approximately straight and parallel sides (e.g., sidewall 25 is shown with an approximately cylindrical shape), for illustrative purposes only. It will be understood that the longitudinal cross-section of first container 20 can comprise substantially non-parallel sides (e.g., FIGS. 3-4B), and/or can comprise one or more portions along its longitudinal length with different widths or diameters (e.g., FIG. 6). In a preferred embodiment, first container 20 comprises a frustro-conical shape (FIGS. 3, 4A, 4B). First container 20 can include one or more handles, surface textures, and/or contoured shapes to facilitate the handling of first container 20.

First container 20 can be a rigid or semi-rigid material, such as metal, glass, ceramic, or plastic, and can be a flexible or semi-flexible material, such as plastic or polystyrene. First container 20 preferably comprises a hydrophobic (e.g., waterproof) material, such that first container 20 can hold a liquid. In a preferred embodiment, first container 20 comprises a material suitable for use with a food product, and even more preferably, a liquid food product. First container 20 can comprise a material selected to provide sufficient support when packaged with the remainder of package 10 (e.g., when second container 30 is inserted into first container 20). In some embodiments, first container 20 can comprise a material with sufficient flexibility to provide a seal and/or facilitate a friction fit between first container 20 and second container 30 when second container 30 is inserted into first container 20, as described further herein. First container 20 can comprise an opaque, translucent, or transparent material. It will be understood that first container 20 can comprise any combination of, and/or can be coated with, one or more of the aforementioned materials. It will be understood that first container 20 can comprise any of many different known materials and shapes for mugs, cups (e.g., disposable cups), drinking glasses, and the like.

Second container 30 can comprise any of many sizes, geometries and materials capable of receiving, storing, and/or serving a material, preferably a food product, and even more preferably, a powdered or granulated food product, such as instant coffee or tea. In some embodiments, second container 30 can be configured to receive, store, and/or serve a plurality of single-serving packets of a material. Second container 30 can comprise any of the geometries and/or materials described herein for first container 20, and can comprise the same or different geometries and/or materials as first container 20. Second container 30 can comprise an upper end 31, a lower end 32, a base 32*a*, one or more sidewalls (e.g., a sidewall 35), an opening 33, and a rim 34 similar to and functioning substantially similar to upper end 21, lower end 22, base 22*a*, sidewall 25, opening 23, and rim 24 of first container 20, respectively, unless stated otherwise herein.

Second container 30 can be sized and shaped to facilitate the insertion of the lower end 32 of second container 30 into the opening 23 of first container 20. In some embodiments, the outer dimensions of the lower end 32 (e.g., the outer diameter of sidewall 35) can be approximately equal to or slightly greater than the inner dimensions (e.g., the inner diameter) of opening 23 of sidewall 25. Such dimensional relationships between lower end 32, sidewall 35, opening 23, and/or sidewall 25 can facilitate a close, interference, or frictional fit between first container 20 and second container 30 when second container 30 is inserted into first container 20 (e.g., by slightly expanding opening 23 and/or sidewall 25). As described above, a frictional fit can form a seal between first container 20 and second container 30, which can prevent foreign contaminants from entering first container 20 during the processing and/or handling of package 10. A seal between first container 20 and second container 30 can also facilitate the packaging of a liquid within first container 20 (e.g., a ready-to-drink beverage or a liquid, such as water (e.g., purified water), to which a powdered instant beverage can be added).

In some embodiments, the outer dimensions of the lower end 32 (e.g., the outer diameter of sidewall 35) can be approximately less than the inner dimensions (e.g., the inner diameter) of opening 23 and/or sidewall 25, to form a clearance between first container 20 and second container 30 when second container 30 is inserted into first container 20. Providing such clearance can facilitate the insertion of the lower end 32 of second container 30 into first container 20. In some embodiments, opening 23 and/or a portion of rim 24 can include a chamfer 28 (FIG. 6) to facilitate insertion of second container 30 into first container 20.

In some embodiments, first container 20 and second container 30 can comprise one or more engaging structures extending from the inner perimeter, diameter, or surface of sidewall 25 and/or the outer perimeter, diameter, or surface of sidewall 35, respectively. Such engaging structures can be configured to engage with a corresponding structure on the other of first container 20 or second container 30 when second container 30 is inserted into first container 20. Such engaging structures may include one or more flanges, beads, tabs or other structures extending around some, most or all of the outer perimeter or circumference of sidewall 35, or the inner perimeter or diameter of sidewall 25. In some embodiments, one or more corresponding mating structures (e.g., one or more recessions or grooves) can extend into the outer perimeter or circumference of sidewall 35, or the inner perimeter or diameter of sidewall 25. The mating structures on first container 20 or second container 30 can be configured to engage with (e.g., with a snap-fit, friction fit, and the like) a corresponding engaging structure on the other of first container 20 or second container 30.

In some embodiments, second container 30 can comprise an optional rim-engaging structure 37 extending outwardly (e.g., radially outwardly) from the sidewall 35. Rim-engaging structure 37 can be configured to contact and rest upon the rim 24 of the first container 20 when the lower end 32 of the second container 30 is inserted into the opening 23 of the first container 20 (FIG. 2). Rim-engaging structure 37 can be shaped and positioned in any of many different ways. In some embodiments, rim-engaging structure 37 can be positioned on sidewall 35 proximate or adjacent to upper end 31 (e.g., opening 33), proximate or adjacent to lower end 32 (e.g., base 32*a*), or anywhere in between. In some embodiments, rim-engaging structure 37 can be positioned longitudinally along sidewall 35 such that when rim-engaging structure 37 contacts and rests upon the rim 24 of the first container 20, an upper portion 38 of second container 30 extends above rim 24 of first container 20. As such, rim-engaging structure 37 can act as a stop that prevents upper portion 38 of second container 30 from being inserted into opening 23 of first container 20. This allows a user to grasp the upper portion 38 when inserting or removing second container 30 to or from the package 10. In some embodiments, rim-engaging structure 37 is positioned longitudinally along sidewall 35 such that when rim-engaging structure 37 contacts and rests upon the rim 24 of the first container 20, a lower portion 39 of second container 30 extends into (e.g., is received by or is surrounded by) first container 20.

It will be understood that rim-engaging structure 37 is not limited to a single, substantially continuous flange extending substantially around the entire outer perimeter of second container 30. Rim-engaging structure 37 can extend around some, most or all of the outer perimeter or diameter of sidewall 35. Rim-engaging structure 37 can comprise one or more flanges (e.g., tabs), beads, or other structures spaced apart from each other (e.g., evenly spaced or irregularly spaced) around the outer perimeter of second container 30. Rim-engaging structure 37 can comprise an ovular, semicircular, rectangular, square or other cross-sectional shape that extends along or wraps around the outer perimeter of second container 30, while providing a structure that can contact and rest upon rim 24.

In some embodiments, assembly 10 can comprise an intermediate structure or insert that can be shaped and positioned to receive second container 30 and be inserted into first container 20. Such an intermediate structure or insert can provide support to second container 30 and/or limit movement of second container 30 with respect to first container 20 when second container 30 is inserted into and received by first container 20. In some embodiments, the insert can suspend second container 30 within first container 20. Such an insert can comprise various handling and/or engagement structures as described elsewhere herein to facilitate the handling of the insert and/or the engagement of the insert with first container 20 and/or second container 30. The insert can comprise paper, plastic, cardboard, or other suitable material with sufficient rigidity to support second container within first container 20. The insert can be configured to receive various portions of second container 30 (e.g., around a portion of the outer diameter of sidewall 35). The insert can support second container 30, for example, by engaging with optional rim-engaging structure 37 and/or a portion of base 32*a*. The insert can also include structure configured to engage with first container 20, to support and/or limit movement of the insert within container 20. In some embodiments, the insert can include a rim-engaging structure extending outwardly (e.g., radially outwardly) from its sidewalls, substantially similar to optional rim-engaging structure 37 on second container 30. Embodiments of such rim-engaging structures can be configured to contact and rest upon the rim 24 of the first container 20 when the insert is inserted into the opening 23 of the first container 20 (FIG. 2). Embodiments of the aforementioned insert can allow portions or all of second container 30 to be suspended or inserted within first container 20 while reducing, minimizing or preventing contact between first container 20 and second container 30. Such inserts can provide padding to protect container 20 and/or 30 during the handling and manufacture of package 10, and/or can facilitate the insertion of second container 30 into first container 20.

Figure 15:
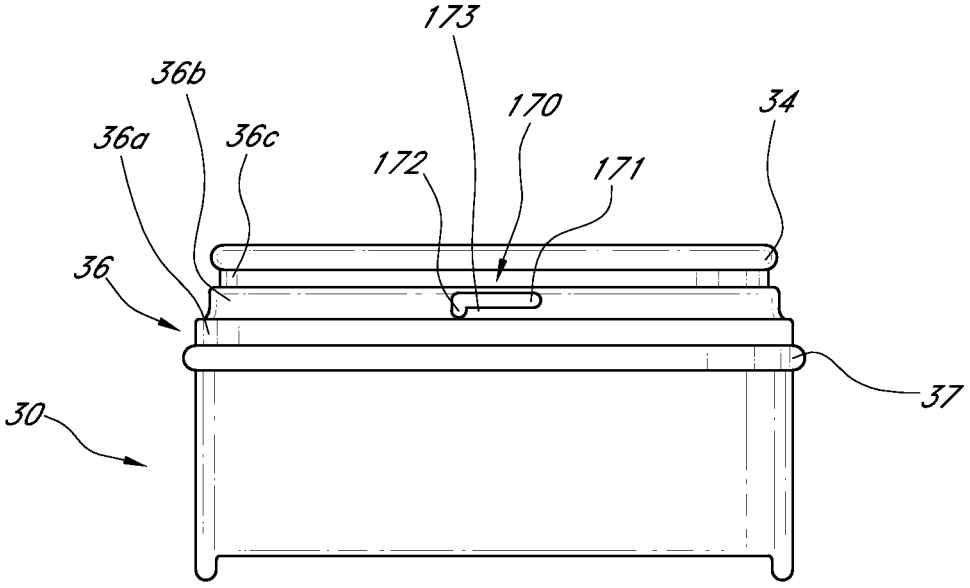
FIG. 15 shows a side view of an embodiment of a container.

It will be understood that the vertical longitudinal cross-section of the second container 30 can comprise substantially non-parallel sides as described above for first container 20 (e.g., FIGS. 3-4B, 6). In some embodiments, the width (e.g. diameter) of second container 30 can vary along the longitudinal length of second container 30. For example, sidewall 35 can comprise a lid-receiving portion 36 that may have a different outer width or diameter relative to the remainder of sidewall 35. Lid-receiving portion 36 can have an outer width or diameter that is greater than, or preferably, less than, the outer width or diameter of the remainder of sidewall 35. In some embodiments, lid-receiving portion 36 can comprise an outer width or diameter sized relative to the remainder of sidewall 35 (e.g., the outer surface of lower portion 39) such that the outer surface of the remainder of sidewall 35 is approximately flush with an outer radial surface of lid 40 (e.g., the outer surface of sidewall 45, described below), when lid 40 engages with second container 30. In some embodiments, lid-receiving portion 36 can comprise a lid-engaging structure that engages with lid 40 (FIG. 15).

Figure 11A:
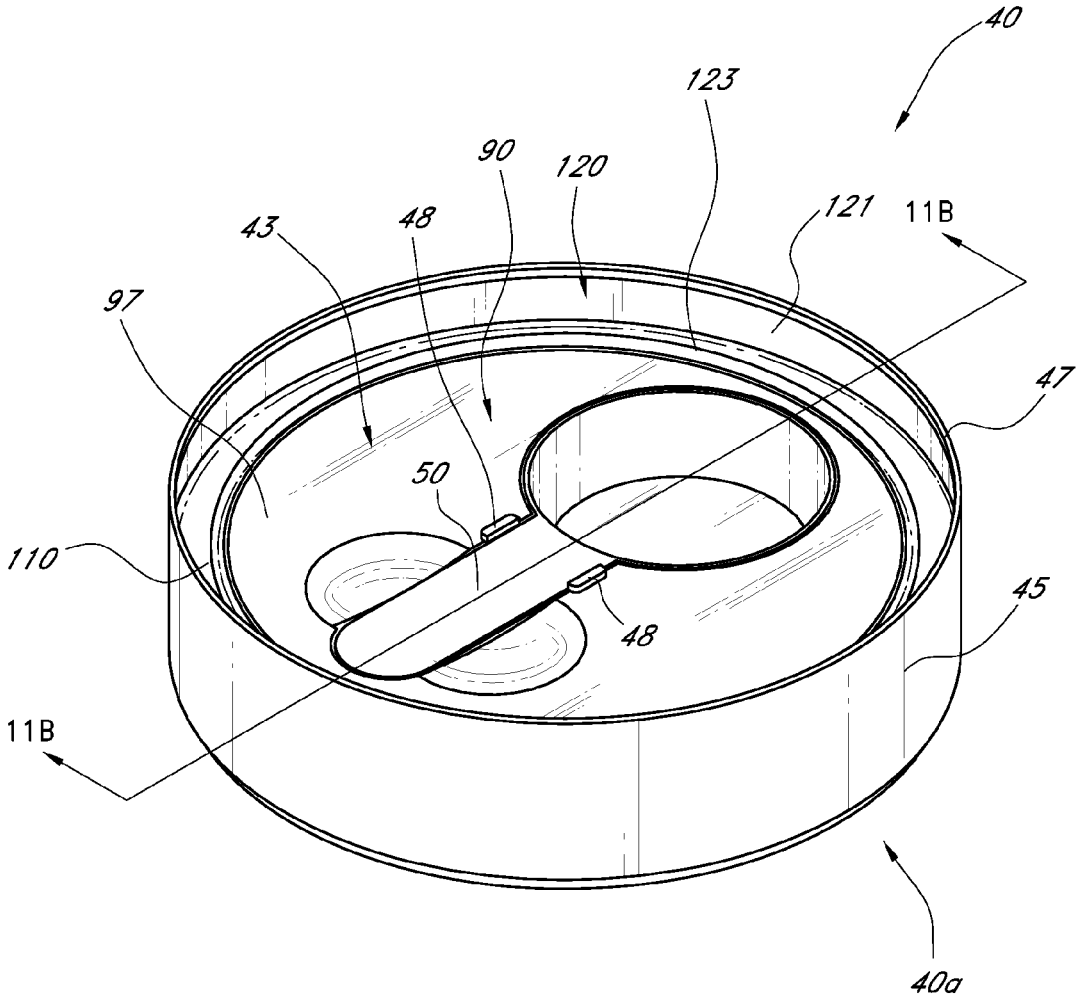
FIG. 11A shows a perspective view of an embodiment of a lid.
Figure 11B:
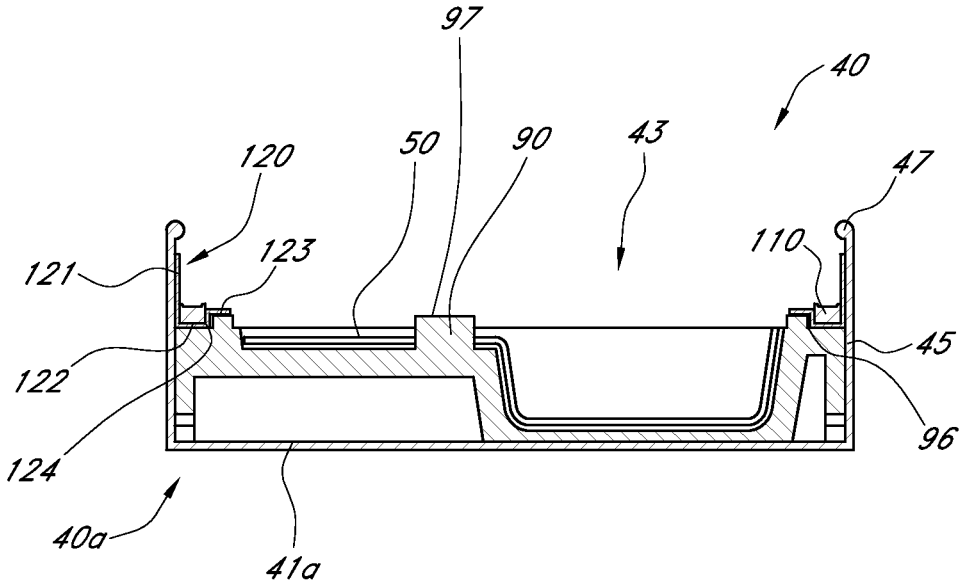
FIG. 11B shows a side cross-sectional view of the lid taken along lines 11B-11B in FIG. 11A.

Lid 40 can comprise any of the geometries and/or materials described herein for containers 20 and 30, and can comprise the same or different geometries and/or materials as containers 20 and 30. In a preferred embodiment, lid 40 can comprise a metal, and more preferably, a magnetic metal, to facilitate the attachment of a magnet thereto. Lid 40 can be configured to engage with and/or cover (e.g., to enclose an interior volume of) second container 30, to protect the contents therein from contaminants, and to prevent the contents from escaping container 30. In some embodiments, lid 40 is configured to seal (e.g., vacuum or hermetically seal) second container 30, to protect and/or preserve the contents of container 30. An illustrative embodiment of lid 40 that includes a seal is shown in FIGS. 11A-11B and described further below. In some embodiments, an optional removable membrane 80 (e.g., a plastic sheet) can be used to provide alternative or additional sealing protection to container 30. The membrane 80 can include any of many suitable shapes and materials that can cover and seal the opening 33 of the container 30. In some embodiments, membrane 80 can be suitably sized and shaped to attach to and provide a seal along rim 34 of second container 30. In some embodiments, second container 30 can comprise a flange or similar structure extending extending at least partially around the inner diameter of sidewall 35 (e.g., extending radially inwardly). Such a flange or similar structure can be configured to engage with membrane 80 and to seal container 30. Such a flange or similar structure can be positioned at various points longitudinally along the inner diameter of sidewall 35 with respect to rim 34. In some embodiments, a flange can be positioned to be offset longitudinally with respect to rim 34, to allow the flange to be recessed with respect to the end of container 30. Such a longitudinal offset can prevent rupturing of membrane 80 when membrane 80 is sealed along such flange or other structure.

In an illustrative embodiment, the membrane 80 can be an approximately circular shape. The membrane 80 can include one or more handling elements, such as a tab, which can be grasped by a user to facilitate the removal of the membrane 80 from the container 30.

Lid 40 can comprise a lid body 40*a* with an upper end 41, a lower end 42, one or more sidewalls (e.g., a sidewall 45), an opening 43 and a rim 44 that can be similar in size, shape, and/or function to upper ends 21, 31, lower ends 22, 32, sidewalls 25, 35, openings 23, 33 and rims 24, 34 of containers 20, 30, respectively, unless stated otherwise herein. Lid 40 can include at least one closed end, to form an internal volume as described herein for containers 20, 30. In the illustrated embodiment, lid 40 comprises a cover 41*a* that is similar to bases 22*a*, 32*a*, wherein cover 41*a* closes the upper end 41 of lid 40. As described further herein, in some embodiments, cover 41*a* can be configured to removably hold the utensil 50. As described further herein, in some embodiments, lid 40 can comprise a lid insert (e.g., lid insert 90; FIGS. 11A-11C) configured to engage with lid body 40*a*.

Lid 40 can be configured to engage second container 30 so that the lid 40 and the second container 30 form an enclosed interior volume to enclose the contents of second container 30. Lid 40 can engage second container 30 in any of many different ways. Lid 40 can engage second container 30 with any of many engagement mechanisms, such as threads, slots, pins, grooves, a snap fit, press fit, frictional fit, and the like. Such engagement mechanisms can be positioned on or integrated with sidewalls 45 and 35 (e.g., the inner and/or outer surfaces thereof), cover 41*a*, and/or rims 34 and 44. In some embodiments, the inner surface of sidewall 45 can be configured to engage with the outer surface of sidewall 35 (e.g., lid-receiving portion 36). In some embodiments, the outer surface of sidewall 45 can be configured to engage with the inner surface of sidewall 35 (e.g., such that cover 41*a* of lid 40 is flush with and/or recessed relative to opening 33 when lid 40 is engaged with second container 30). In some embodiments, lid 40 can engage second container 30 by engaging rim 34 with a surface of cover 41*a*. In some embodiments, lid 40 can engage second container 30 by engaging rim 44 with rim 34 or rim-engaging structure 37.

In some embodiments, lid 40 can comprise one or more optional flanges that are substantially similar to rim-engaging structure 37. In the illustrated embodiment, lid 40 includes an annular flange 47 extending radially from sidewall 45 around the opening 43. Flange 47 can be grasped by a user to facilitate the removal of lid 40 from second container 30. In some embodiments, flange 47 can contact, rest upon, and/or engage with rim-engaging structure 37 on second container 30 when lid 40 engages with second container 30. In some embodiments, a gap can form between flange 47 and rim-engaging structure 37 when lid 40 engages with second container 30, to facilitate the removal of lid 40 from second container 30. In some embodiments, sidewall 45 can be longer than lid-receiving portion 36 on container 30, such that a gap is formed between the surface of cover 41*a* and rim 34 when lid 40 engages with second container 30. Such a gap can allow utensil 50 to be held to lid 40, without interfering with optional removable membrane 80 that may be used to cover (e.g., seal) opening 33 of container 30.

In some embodiments, a flange can be positioned to extend at least partially around the inner diameter of sidewall 45, to provide a stop that engages with rim 34 on second container 30 to limit the amount of possible engagement between lid 40 and second container 30. Such an embodiment can also form a gap between the surface of cover 41*a* and rim 34, to allow utensil 50 to be held to lid 40, without interfering with an optional removable membrane covering opening 33 of container 30.

Utensil 50 can comprise any of many different materials, such as metal or plastic, and preferably, comprises a food-safe (e.g., chemically inert) metal or plastic, and more preferably, a food-safe metal or plastic that can safely and reliably withstand a broad range of temperatures (such as the temperature of ice cream or a boiling cup of coffee). Utensil 50 can be used to handle (e.g., receive, serve and/or stir) any of the many different types of material that can be held within containers 20 and 30. For example, utensil 50 can be used to remove instant coffee powder from container 30, pour the instant coffee powder into container 20, and stir the instant coffee powder with hot water placed into container 20. In some embodiments, a separate utensil can be packaged within container 20, that can be used for stirring a beverage in container 20, to prevent utensil 50 from contacting moisture, and potentially contaminating the instant coffee powder stored in container 30 if utensil 50 is reattached to lid 40 after use. In the illustrated embodiment, utensil 50 comprises a member 51 (e.g., a handle) with a material-engagement portion 52 at an end of utensil 50 to hold, serve, and/or stir material. Material-engagement portion 52 can include a material-receiving portion 53, illustrated here as a concave surface which forms a cavity that can receive and hold material with utensil 50. Utensil 50 can comprise any of many known configurations. For example, utensil 50 can comprise a scoop or spoon. In a preferred embodiment, utensil 50 comprises a material-receiving portion 53 that is sized to receive and hold a single-serving of a powdered beverage (e.g., instant coffee).

Utensil 50 can be configured to be held (e.g., removably held) on either side of lid 40 (e.g., the upper or lower side of cover 41*a*) relative to second container 30, when lid 40 is engaged with the second container 30. Preferably, utensil 50 is held on the side of lid 40 that engages second container 30, such that utensil 50 is held within an enclosed interior volume (e.g., of lid 40 and/or second container 30), and thus protected from contaminants and external forces during the handling of package 10. Utensil 50 can be sized, shaped, and removably held to lid 40 in a manner that prevents interference between utensil 50 and second container 30 when lid 40 is engaged with second container 30. In the embodiments described herein that include removable membrane 80, utensil 50 can be sized, shaped and removably held to lid 40 in a manner that prevents interference between utensil 50 and the membrane. In some embodiments, utensil 50 is alternatively removably attached to the removable membrane 80.

Utensil 50 can be held (e.g., removably held) to lid 40 with any of many different utensil-holding structures provided on utensil 50 and/or lid 40, such as adhesive (e.g., a removable adhesive) and/or mechanical fasteners (e.g., Velcro, snaps, screws, clips, hooks, tabs, hinges, suction cups, and the like). In some embodiments, utensil 50 and lid 40 can comprise a magnet and/or magnetic material (FIG. 8), such that utensil 50 and lid 40 can be removably held to each other with a magnetic force. In some embodiments, lid 40 and/or utensil 50 can comprise one or more protruding or recessed structures (e.g., tabs, flanges, grooves, and the like) that are configured to removably engage with a corresponding structure on the other of lid 40 and utensil 50 (e.g., through an interference fit). In some embodiments, lid 40 can comprise a protruding member that forms a press fit with the surface of material-receiving portion 53. In some embodiments, utensil 50 can be positioned within the interior volume of lid 40, such that the opposing ends of utensil 50 engage with the opposing inner surfaces of sidewall 45, to removably hold utensil 50 to lid 40. In some embodiments, lid 40 can comprise a pair of holding members 48 (FIG. 7) extending from a surface of the lid 40 (e.g., the lower surface). The holding members 48 can be configured to receive and secure handle 51 of utensil 50 when the handle 51 is positioned between the holding members 48. It will be understood that holding members 48 can comprise many different cross-sectional shapes (e.g., rectangular, triangular, etc) extending from lid 40 that will sufficiently receive and secure utensil 50 to a surface of lid 40.

Package 10 can comprise one or more securing strips configured to engage with (e.g., secure and/or hold) various components of package 10 relative to each other during the handling and use of package 10. The securing strips described herein can comprise any of many different materials, with various levels of engagement between the components of package 10, and with various levels of optional adhesion between the securing strips and the components of package 10. The securing strips can comprise any of many membranes and films known in the art, such as shrink films (e.g., polymer plastics, polyolefin, and the like, including those that are heat activated), cling films (e.g., PVC and the like, including those without adhesive), adhesive-backed paper or cardboard, etc. The thickness, dimensions, and materials used for the securing strips can be selected based upon the functionality desired for the securing strips. For example, but without limitation, when the securing strips are selected to provide a tamper-evident seal, a thin, small, adhesive-backed paper might be used, whereas a tamper-resistant seal or a seal to prevent contamination (e.g., within second container 30) might comprise a thicker, heat-shrink film.

Each securing strip described herein can be configured to engage with the first container 20, the second container 30 and/or the lid 40, or any combination of two or all three of these components of package 10. The securing strips can be positioned on (e.g., adhered to) any of many different portions of first container 20, second container 30 and lid 40 to provide such engagement. For example, the securing strips can be positioned on a portion of base 22*a* and sidewall 25 (e.g., upper or lower portions 21 and 22) of first container 20. The securing strips can be positioned on a portion of base 32*a* and sidewall 35 (e.g., upper or lower portions 31 and 32) of second container 30. The securing strips can be positioned on a portion of cover 41*a* and sidewall 45 (e.g., upper or lower portions 41 and 42) of lid 40. The securing strips can be positioned on flange 47 of lid 40 and/or on rim-engaging structure 37 of second container 30, to provide additional roughness and surface area for the engagement (e.g., sealing) between lid 40, second container 30, and/or first container 20. In some embodiments, the securing strips can be positioned to wrap around some, most or all of any of the above-listed features of first container 20, second container 30 and lid 40. In some embodiments, the securing strips can be positioned to form a loop around one or more of the first container 20, second container 30 and lid 40.

In the illustrative embodiment of FIGS. 1 and 2, securing strip 60 can be positioned to engage with lid 40 (including, e.g., a portion of sidewall 45, cover 41*a*, and/or flange 47), second container 30 (including, e.g., rim-engaging structure 37), and first container 20 (including, e.g., upper portion 21 and/or sidewall 25). In this embodiment, securing strip 60 can engage with the first container 20, the second container 30, and the lid 40 when the lower end 32 of the second container 30 is inserted into the opening 23 of the first container 20 and the rim-engaging structure 37 rests upon the rim 24. It will be understood that although FIGS. 1 and 2 show strip 60 engaging with the first container 20, the second container 30, and the lid 40, a securing strip can engage the first container 20 to the second container 30 without engaging the lid 40, and one or more separate (e.g., additional or alternative) securing strips can be provided to engage the second container 30 to the lid 40 without engaging the first container 20 (e.g., FIGS. 3-4), or the lid 40 to the first container 20 without engaging the second container 30.

FIG. 3 shows a front elevational view of an embodiment of a package 110 for storing and serving a powdered instant beverage. Package 110 be similar to and function substantially similar to package 10. One difference is that package 110 can comprise a first container 120 and a second container 130 that are tapered (e.g., with tapered sidewalls 125 and 135, respectively), for aesthetic purposes and/or to facilitate the insertion of second container 130 into first container 120. As such, first container 120 and second container 130 can comprise a frustro-conical shape. Package 110 can comprise a securing strip 61 that is adhered to (e.g., configured to engage with) second container 130 and lid 140. Securing strip 61 is positioned on second container 130 and lid 140 such that a portion of securing strip 61 (e.g., the portion attached to an upper portion 131 of second container 130) is contained within first container 120 (and thus protected from inadvertent removal) when second container 130 is inserted into first container 120. As described above, the securing strips 60 (FIGS. 1 and 2) and 61 (FIG. 3) can be used separately or in combination with each other with the various package embodiments described herein.

FIGS. 4A and 4B show a top and front elevational view, respectively, of an embodiment of package 110 shown in FIG. 3. Package 110 can include a securing strip 62 that comprises a loop that can be configured to wrap (e.g., longitudinally wrap) around first container 120, second container 130 and lid 140. Forming a loop with securing strip 62 can strengthen the engagement between strip 62, first container 120, second container 130 and lid 140, for reliability during the handling of package 110, and to prevent disengagement of these components. It will be understood that securing strip 62 can be implemented with package 10 (FIGS. 1 and 2) or package 210 (FIG. 6), and can be used in combination with or as an alternative to securing strips 61 and 62. It will also be understood that a securing strip substantially similar to strip 62 can be implemented that forms a loop solely around lid 140 and second container 130.

Figure 5:
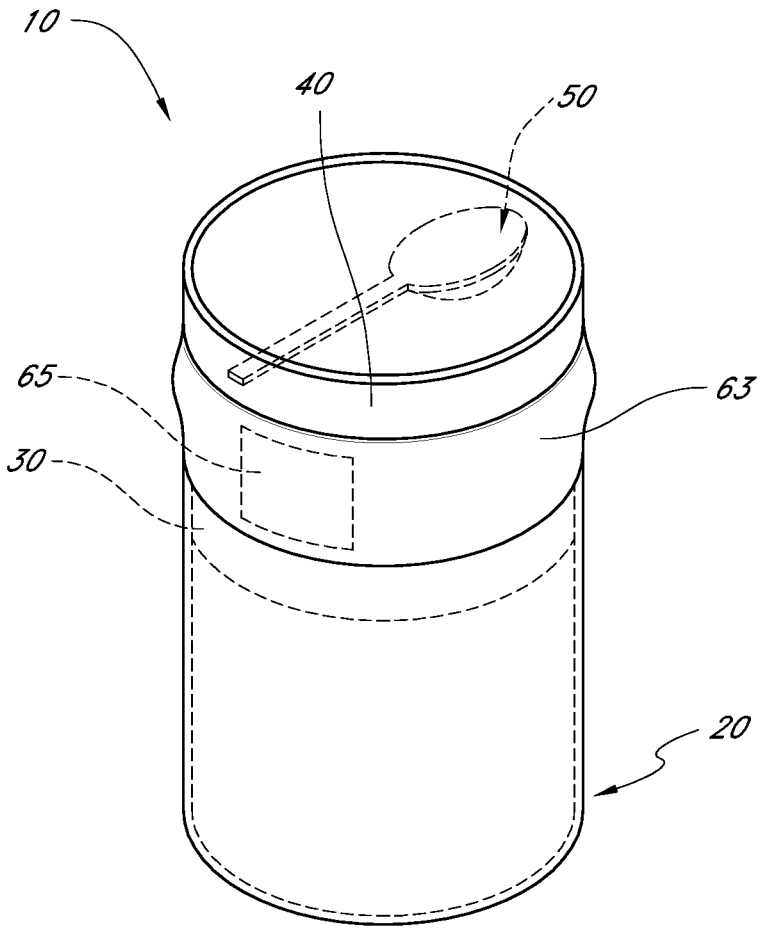
FIG. 5 shows a front elevational view of an embodiment of the package shown in FIGS. 1 and 2, with a securing strip that forms a loop.

FIG. 5 shows a front elevational view of an embodiment of the package 10 shown in FIGS. 1 and 2. Package 10 can include a securing strip 63 that comprises a loop configured to wrap around (e.g., transversely wrap, i.e., around the perimeter or circumference) first container 20, second container 30 and lid 40. Forming a loop with securing strip 63 can strengthen the engagement between strip 63, first container 20, second container 30 and lid 40, for reliability during the handling of package 10, and to prevent disengagement of these components. In a preferred embodiment, securing strip 63 can form a complete seal around the entire perimeters (e.g. circumference) of and between lid 40, second container 30, and first container 20. It will be understood that securing strip 63 can be implemented with package 110 (FIGS. 3-4B) and package 210 (FIG. 6), and can be used in combination with or as an alternative to securing strips 60, 61 and/or 62. It will also be understood that a securing strip substantially similar to strip 63 can be implemented that forms a loop solely around lid 40 and second container 30, but not first container 20, or solely around second container 30 and first container 20 but not lid 40. FIG. 5 also shows an embodiment of securing strip 63 that can include product indicia 65 printed on its surface, to label package 10 and its components as desired. Product indicia can be similarly printed on the other securing strips disclosed herein.

Figure 6:
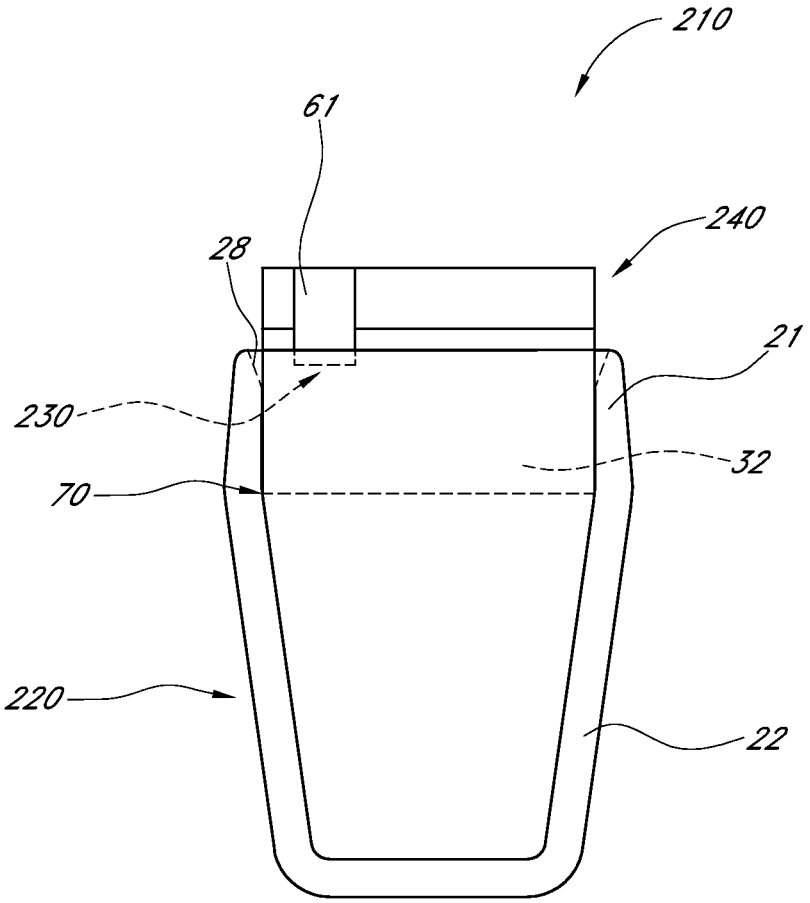
FIG. 6 shows a front elevational view of another embodiment of a package for storing and serving a powdered instant beverage.

FIG. 6 shows a front elevational view of an embodiment of a package 210 for storing and serving a powdered instant beverage. Package 210 can be similar to and function substantially similar to packages 10 (FIGS. 1, 2 and 5) and 110 (FIGS. 3-4B). One difference is that the lower portion 22 of the first container 20 can be sized and shaped to inhibit insertion of the lower portion 32 of the second container 30 into the lower portion 22. In some embodiments, the second container 30 can rest upon the first container 20 when the lower portion 32 of the second container 30 is inserted into the upper portion 21 of the first container 20.

First container 20 can inhibit insertion of the second container 30 into the lower portion 22 of the first container 20 in any of many different ways. In some embodiments, a structure (e.g., a structure similar to rim-engaging structure 37 (FIGS. 1-2)) can be positioned on the inner surface of sidewall 25, at the transition between lower portion 22 and upper portion 21, to act as an edge stop, on which second container 30 can rest when inserted into first container 20. In some embodiments, the inner dimensions (e.g., inner diameter) of lower portion 22 can be less than the inner dimension (e.g. inner diameter) of the upper portion 21, to form a shelf or ledge that can act as an edge stop on which second container 30 can rest when inserted into first container 20. In some embodiments, the lower portion 22 of first container 20 can be angled relative to the upper portion 21, to form a transition or edge stop 70 that inhibits insertion of the second container into the lower portion 22 of the first container 20. As such, the outer diameter of second container 30 be sized relative to the inner diameter of the transition or edge stop 70 such that second container 30 can rest upon or proximate to the transition or edge stop 70 of first container 20 when the lower portion 32 of the second container 30 is inserted into the upper portion 21 of the first container 20.

Figure 7:
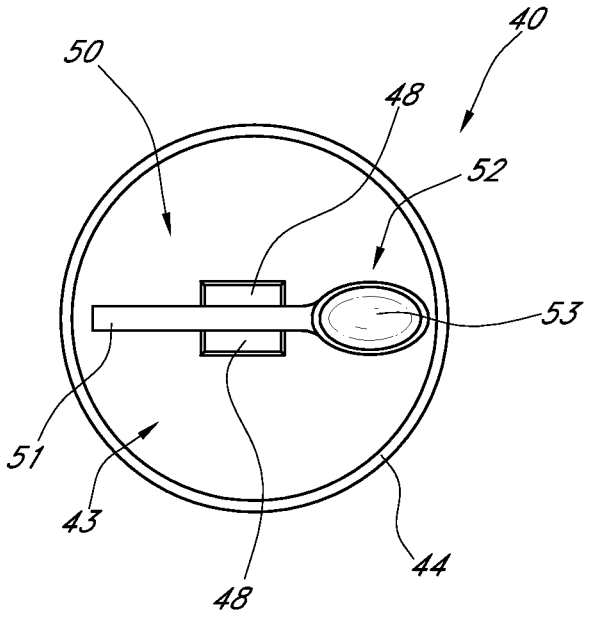
FIG. 7 shows a bottom view of an embodiment of a lid with a utensil-holding structure for removably securing a utensil to the lid.

FIG. 7 shows a bottom view of an embodiment of a lid with a utensil-holding structure for removably securing a utensil to the lid. Lid 40 comprises holding members 48 configured to receive and hold the handle 51 of utensil 50, as described previously herein.

Figure 8:
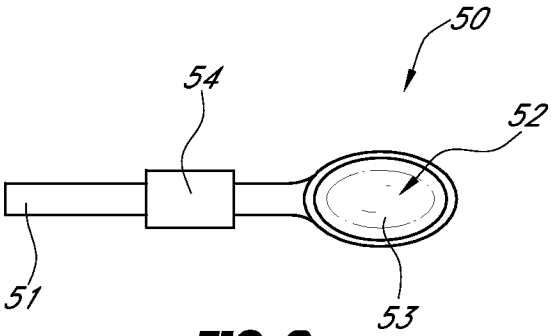
FIG. 8 shows an embodiment of a utensil with a utensil-holding structure comprising a magnet.

FIG. 8 shows an embodiment of a utensil 50 with a utensil-holding structure comprising a magnet 54. Magnet 54 can be configured to removably secure utensil 50 to the lids 40 (FIGS. 1, 2, 5 and 6) or 140 (FIGS. 3-4B), when the lids comprise magnetic material (e.g., a metal). It will be understood that magnet 54 can be made separate from or integrally with utensil 50, and can be positioned anywhere along the length of utensil 50 to engage utensil 50 with lids 40 or 140. In some embodiments, the entirety of utensil 50 can comprise a single, integral magnet. In some embodiments, the magnet 54 can be coated with an inert, food-safe material.

Figure 9:
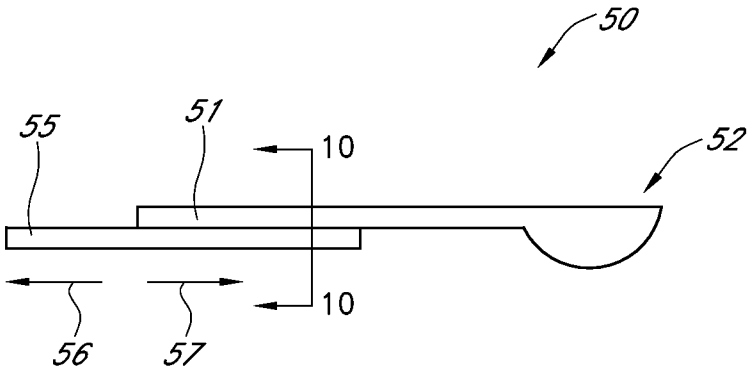
FIG. 9 shows an embodiment of a utensil comprising a first member slidingly engaged with a second member.
Figure 10:
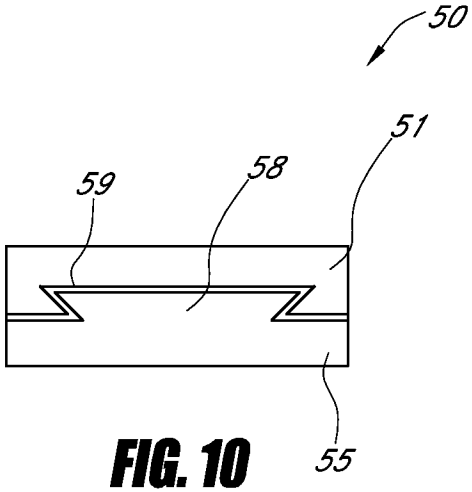
FIG. 10 shows a front cross-sectional view of the utensil taken along lines 10-10 in FIG. 9.

FIG. 9 shows an embodiment of a utensil 50 comprising a first member 51 slidingly engaged with a second member 55. FIG. 10 shows a front cross-sectional view of the utensil 50 taken along lines 10-10 in FIG. 9. First member 51 can be slidingly engaged with second member 55 to allow the length of utensil 50 to be varied when first member 51 and second member 55 are moved relative to each other. For example, when first member 51 is moved relative to second member 55 in the direction shown by arrow 56, the overall length of utensil 50 will decrease. When first member 51 is moved relative to second member 55 in the direction shown by arrow 57, the overall length of utensil 50 will increase. A reduced length of utensil 50 can facilitate the attachment of utensil 50 to a lid. An increased length of utensil 50 can facilitate a user's removal, serving and/or stirring of material held within a container. Utensil 50 can be slidingly engaged in any of many different ways. In the illustrative embodiment, member 51 comprises a recessed portion 59 which can receive a protruding portion 58 of member 55, wherein the recessed portion 59 and protruding portion 58 are configured to facilitate longitudinal relative movement, while preventing transverse relative movement.

FIG. 11A shows a perspective view of an embodiment of lid 40. FIG. 11B shows a side cross-sectional view of lid 40 taken along lines 11B-11B in FIG. 11A. Lid 40 can comprise a lid insert 90 configured to engage with and/or be secured (e.g., removably or permanently secured) to the lid body 40*a*, and to removably hold a utensil 50, as described further herein. In some embodiments, the lid insert 90 can be removably secured to the lid body 40*a*, for example, to facilitate the removal and replacement of the insert 90 from the lid body 40*a* (e.g., so that lid 40 can accommodate various sizes and/or shapes of utensil 50). Lid 40 can comprise a cover 41*a*, sidewall 45 and annular flange 47, as described further herein (FIGS. 1, 2 and 5). One difference is that FIGS. 11A and 11B show an embodiment of annular flange 47 that extends radially inwardly from sidewall 45. In FIGS. 11A and 11B, the flange 47 comprises an inwardly bent, folded, or rolled up portion of the lower edge of the sidewall 45. Note that lid 40 and its features shown in FIGS. 11A-13B are positioned upside-down relative the orientation of lid 40 shown in FIGS. 1, 2 and 5. Thus, any terms describing the orientation of lid 40 and its features in FIGS. 11A-13B (e.g., "lower," "upper," etc.) correspond to that orientation when lid 40 is positioned to be engaged with second container 30, as shown in FIGS. 1, 2, and 5. It will also be understood that the embodiments of the features of lid 40 shown in FIGS. 11A-13B can be implemented with embodiments of packages 110 (FIGS. 3-4B) and 210 (FIG. 6).

Figure 12B:
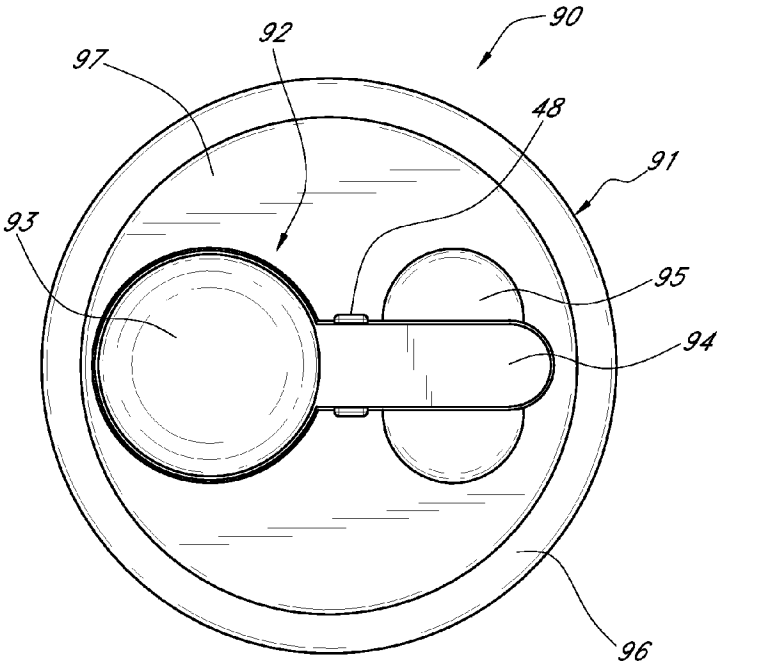
FIGS. 12A-12C show a perspective, top, and side view, respectively, of an embodiment of a lid insert.
Figure 12C:
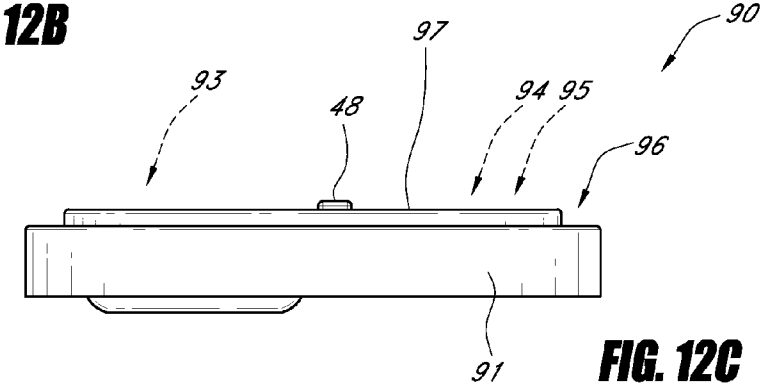
Figure 12A:
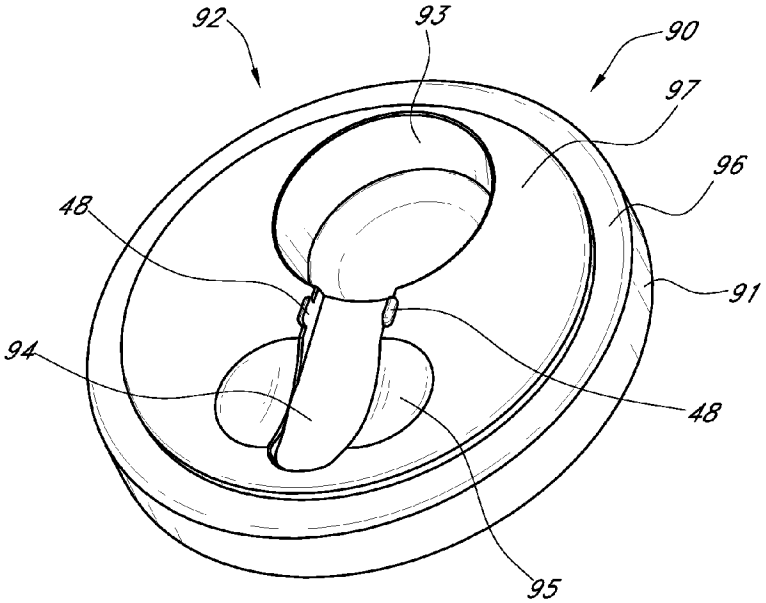

FIGS. 12A-12C show a perspective, top, and side view, respectively, of an embodiment of lid insert 90. Referring to FIGS. 11A-12C, lid insert 90 can be configured to engage with (e.g., be secured to) lid body 40*a*. Lid insert 90 is optional, and can be separate from or integrally formed with lid body 40*a*. Lid insert 90 can be separate from lid body 40*a*, for the aforementioned removal and replacement of lid insert 90 from lid body 40*a*. Lid insert 90 can be configured to removably secure a utensil 50 to lid 40. In some embodiments, lid insert 90 can include holding members 48 to receive and removably secure a utensil to lid 40, as described further herein (FIG. 7). Lid insert 90 can comprise many different shapes and materials, such as those described herein for first container 20, second container 30, and lid 40. In some embodiments, lid insert 90 can comprise a metal and/or plastic (e.g., thermoplastic) material. Lid insert 90 can comprise the same or a different material than lid body 40*a*. In a preferred embodiment, lid insert 90 can be a different material (e.g., a material with greater flexibility) than the material used for the lid body 40*a*. For example, lid insert 90 can comprise a material with sufficient flexibility to facilitate the insertion of lid insert 90 into the opening 43 of lid body 40*a*, and/or to facilitate the securing of utensil 50 (e.g., through a friction fit and the like) to lid insert 90. Lid body 40*a* can comprise a material with sufficient rigidity to protect and hold the contents of container 30 when the lid 40 is secured to container 30. In a preferred embodiment, lid insert 90 is a thermoplastic and lid body 40*a* is a metal (e.g., tin). In some embodiments, lid insert 90 can comprise an approximately circular top cross-sectional shape.

Lid insert 90 can engage with lid body 40*a* with any of many engagement mechanisms, such as those described herein for engaging lid 40 with second container 30, and/or with adhesives, welding, soldering, ultrasonic bonding, snap fit, press fit and the like. Lid insert 90 can be configured to be selectively removably or permanently engaged with lid body 40*a*. In some embodiments, lid body 40*a* can comprise an additional retaining structure, such as a ring (e.g., snap ring), sleeve, or collar (e.g., a collar 120; FIGS. 11A, 11B, 13A, 13B) configured to secure lid insert 90 within lid body 40*a*.

Continuing to refer to FIGS. 11A-11B and 12A-12C, lid insert 90 can be configured to engage with lid body 40*a* proximate to and/or on an upper side (e.g., the upper surface) of cover 41*a* (FIG. 1; 11B). In some embodiments, lid insert 90 can engage with lid body 40*a* such that a utensil (e.g., utensils 50 or 150), when removably secured to lid insert 90, is not enclosed within an interior volume of second container 30 when lid 40 is engaged with second container 30, as described above. Such embodiments can keep material (e.g. instant coffee, etc.) stored within second container 30 separate from lid insert 90 and utensil 50 during shipment, storage and handling of package 10.

Lid insert 90 can also be configured to engage with lid body 40*a* proximate to and/or on a lower side (e.g., the lower surface) of cover 41*a*. In some embodiments, lid insert 90 can engage with lid body 40*a* such that a utensil (e.g., utensil 50 or 150), when removably secured to lid insert 90, is enclosed within an interior volume of second container 30 and/or lid 40 when lid 40 is engaged with second container 30 (FIGS. 1, 2, 5, and 11A-11B). Such embodiments can protect lid insert 90 and the utensil from foreign contaminants during the shipment, storage and handling of package 10, and/or prevent the loss of the utensil.

Lid insert 90 can be configured to be received by lid body 40*a*, for example, by inserting lid insert 90 into an opening formed by sidewalls extending from the cover 41*a* of lid body 40*a* (e.g., opening 43, formed by sidewalls 45). In some embodiments, lid insert 90 can comprise a sidewall 91 extending around the perimeter of lid insert 90, wherein the sidewall can be configured to be inserted into an opening in lid body 40*a* (e.g., opening 43). In some embodiments, sidewall 91 can engage with the inner perimeter of sidewall 45. In some embodiments, lid insert 90 can be configured to allow a gap between sidewall 91 and sidewall 45 when lid insert 90 is received by lid body 40*a*.

Referring to FIGS. 1, 2, 5, 11A-11B and 12A-12C, lid insert 90 can be positioned relative to lid body 40*a* such that, when lid 40 is engaged with second container 30 (FIGS. 1, 2 and 5), and when lid insert 90 is engaged with lid body 40*a* (FIGS. 11A-11B), a gap is formed between the surface of lid insert 90 and rim 34. In some embodiments, lid insert 90 can be positioned relative to lid body 40*a*, such that a surface of lid insert 90 can engage with rim 34 when lid 40 is engaged with second container 30, and when lid insert 90 is engaged with lid body 40*a*. In some embodiments, lid insert 90 can comprise a step or shoulder 96 (FIGS. 12A-12C) extending around the outer perimeter of the surface of lid insert 90 that can engage with rim 34 when lid 40 is engaged with second container 30. Referring to FIGS. 11A-12C, in some embodiments, a seal 110 (e.g., a plastisol seal) can be positioned at or around the outer perimeter of lid insert 90 (e.g., within shoulder 96) (FIGS. 11A-11B). Such a seal can secure lid insert 90 to lid body 40*a* and/or engage with (e.g., seal) rim 34 with lid 40 when lid 40 is engaged with second container 30 (FIGS. 1, 2 and 5).

Lid insert 90 can comprise one or more recesses extending into a surface of lid insert 90. These recesses can provide an aesthetic appeal, prevent the accidental removal of utensil 50 from lid insert 90, and/or facilitate the attachment or removal of utensil 50 to and from lid insert 90. In some embodiments, lid insert 90 can comprise a utensil recess 92, to facilitate a flush or recessed attachment of all or a portion of utensil 50 to lid insert 90 (e.g., with respect to an interior or lower surface 97 of lid insert 90). A flush or recessed attachment of all or a portion of utensil 50 to lid insert 90 can reduce the likelihood of all or a portion of utensil 50 puncturing or perforating membrane 80 (FIG. 1), when the membrane 80 is positioned between lid 40 and container 30, and when lid 40 is engaged with container 30 (FIG. 1). Utensil recess 92 can be configured to receive some, most or all of the utensil 50, when the utensil 50 is secured (e.g. removably secured) to lid insert 90. In some embodiments, utensil recess 92 can comprise a material-engagement recess 93 configured to receive material-engagement portion 52 of utensil 50. In some embodiments, utensil recess 92 can comprise a member recess (or handle recess) 94 configured to receive member or handle 51 of utensil 50.

In some embodiments, lid insert 90 can comprise one or more handling recesses configured to facilitate the removal and securing of the utensil 50 to the lid insert 90. In the illustrated embodiment, the handling recesses comprise a pair of fingertip recesses 95 extending on opposing sides of the handle 51 when the material-engagement portion 52 is received within the material-engagement recess 93 and the handle 51 is received within the handle recess 94. Each fingertip recess 95 is preferably configured to accommodate a user's fingertips while disengaging or securing the utensil with respect to the lid insert 90. Fingertip recesses 95 can extend on either or both sides of member recess 94.

In some embodiments, lid insert 90 and utensil 50 can be configured such that utensil 50 can be removably secured to lid insert 90 in at least two orientations, including, in some embodiments, a first orientation in which a side of the utensil 50 faces downward, and a second orientation in which the side of the utensil 50 faces upward. In an illustrative first orientation, utensil 50 can be secured to and oriented with respect to lid insert 90 such that a portion of utensil 50 (e.g., material engagement portion 52; FIG. 9) is received by the utensil recess 92, and is recessed or flush with the lower surface 79 of lid insert 90 (e.g., such that a side of the utensil 50, e.g., the concave surface of the material-receiving portion 53, faces towards the opening 43 of lid 40, or downward). The illustrative first orientation can reduce the likelihood of perforation of membrane 80 when membrane 80 seals container 30 (FIG. 1). The utensil 50 can alternatively be secured or re-secured to lid insert 90 in an illustrative second orientation, after membrane 80 is removed, e.g., after the utensil 50 has been initially removed from lid insert 90 (e.g., to make a cup of coffee). In the illustrative second orientation, after the membrane 80 has been removed, utensil 50 can be secured to and oriented with respect to lid insert 90 such that a portion of utensil 50 (e.g., the material-receiving portion 52; FIG. 9) is no longer received by the utensil recess 92, and is no longer flush with lower surface 97 of lid insert 90 (e.g., such that the side of the utensil, e.g., the concave surface of the material-receiving portion 53, faces towards the cover 41*a* of lid 40, or upward). Allowing utensil 50 to be secured to lid insert 90 in at least two or more orientations simplifies the attachment, removal and reattachment of the utensil to the lid insert 90 for the user.

Figure 13A:
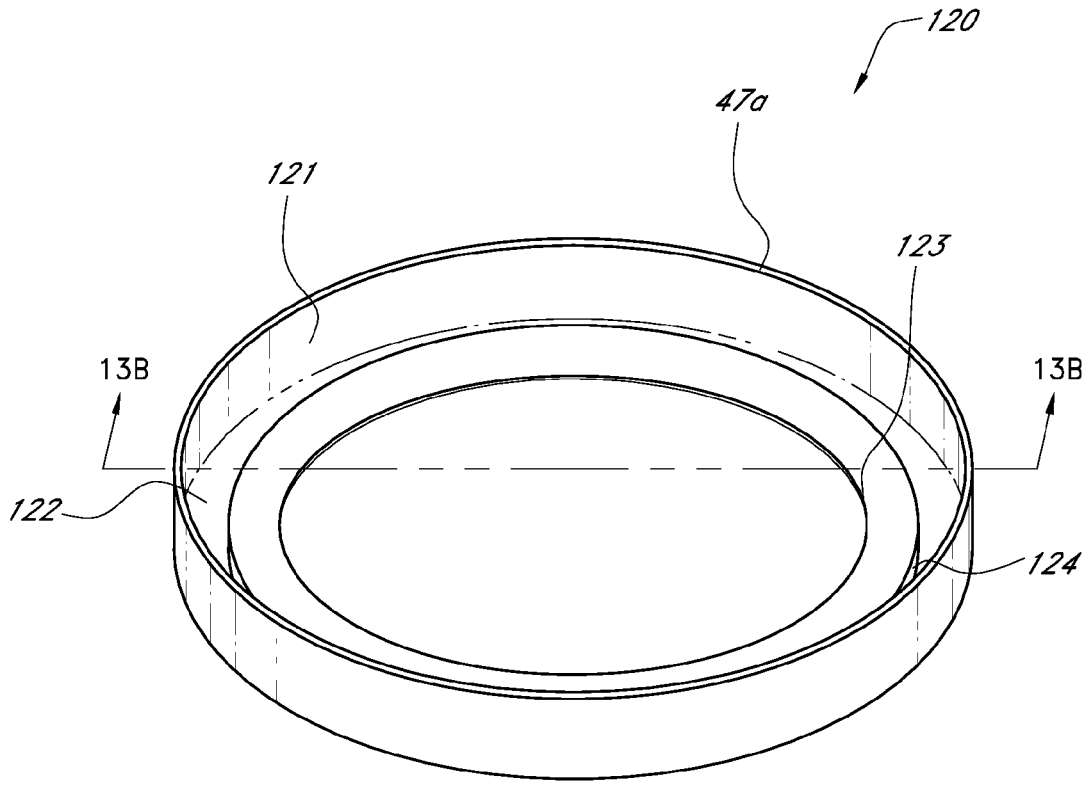
FIG. 13A shows a perspective view of an embodiment of a collar.
Figure 13B:
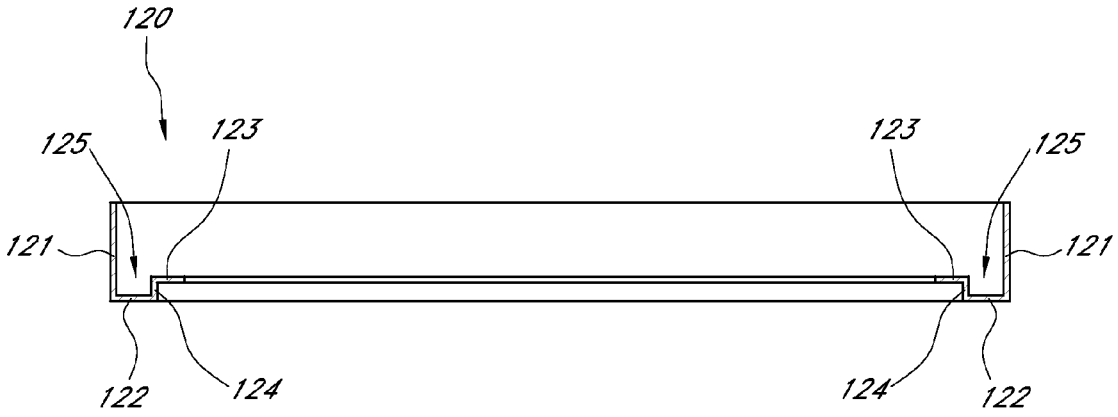
FIG. 13B shows a front cross-sectional view of the collar taken along lines 13B-13B in FIG. 13A.

FIG. 13A shows a perspective view of an embodiment of a collar 120. FIG. 13B shows a front cross-sectional view of the collar 120 taken along lines 13B-13B in FIG. 13A. Referring to FIGS. 11A-11B and 13A-13B, collar 120 can comprise any of many retaining structures configured to secure and retain lid insert 90 within lid body 40*a*. Collar 120 can comprise an outer sidewall 121 (e.g., a vertical sidewall) configured to engage with a portion of lid body 40*a*, such as the inner perimeter of sidewall 45. In some embodiments, outer sidewall 121 can have approximately flush with (e.g., a press fit) the inner surface of sidewall 45. In some embodiments, the flange 47 of lid 40 can act as a stop, to prevent sidewall 121 from being disengaged with or removed from lid 40 (FIGS. 11A-11B). Sidewall 121 can have an approximately cylindrical shape, or any other shape configured to engage with a portion of lid body 40*a*, such as the inner perimeter of sidewall 45.

Collar 120 can comprise an annular portion 123 extending radially inwardly from sidewall 121. Annular portion 123 can comprise an annular shelf, ledge, and/or plurality of tabs configured to engage with lid insert 90 (e.g., an outer lower surface of insert 90), to hold lid insert 90 within lid body 40*a*. Collar 120 can comprise a trench, groove, or recess 125 extending around an inner perimeter of sidewall 121. Recess 125 can be configured to receive seal 110 (FIGS. 11A and 11B), as described further herein. Collar 120 can be configured in any of many different ways to form recess 125. For example, collar 120 can comprise a curved or radiused portion extending between annular portion 123 and sidewall 121 to form recess 125. In some embodiments, collar 120 can comprise an optional second annular portion 122 (e.g., a second shelf) and a second sidewall 124 to form recess 125 between annular portion 123 and sidewall 121. It will be understood that second annular portion 122 is shown approximately orthogonal to sidewalls 121 and 124, and sidewall 124 is shown approximately orthogonal to annular portion 123, for illustrative purposes only, and these components can be configured at various angles to form recess 125. In some embodiments, the inner perimeter (e.g., circumference) of sidewall 124 can be configured to engage with the shoulder 96 of lid insert 90 (FIG. 11B).

Figure 14C:
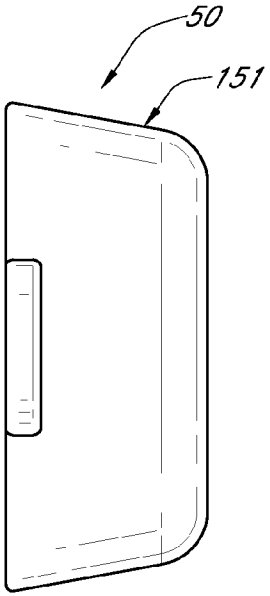
FIGS. 14A-14C show a top, side and front view, respectively, of an embodiment of a utensil.
Figure 14A:
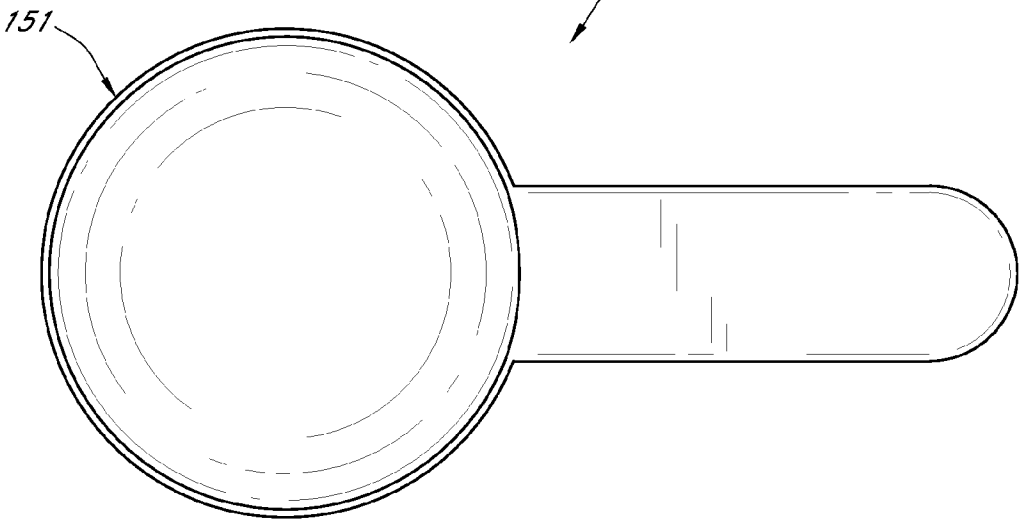
Figure 14B:
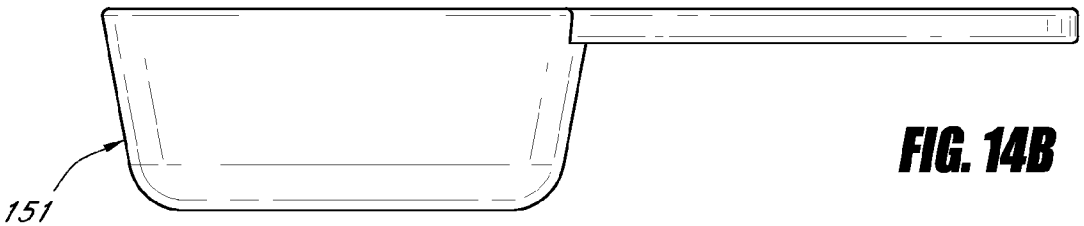

FIGS. 14A-14C show a top, side and front view, respectively, of an embodiment of utensil 50 that can be used with the various embodiments of package 10 described herein. In the illustrative embodiment, utensil 50 comprises a scoop with a material-receiving portion 151 with a sloped sidewall comprising an approximately frustro-conical shape.

FIG. 15 shows a side view of an embodiment of container 30. Container 30 is shown for illustrative purposes with rim 34 configured as a crimped, or curved rim. Lid-receiving portion 36 is shown for illustrative purposes with a plurality of stepped portions (e.g., shoulders) 36*a*, 36*b*, and 36*c*. In some embodiments, stepped portion 36*c* can comprise a smaller radius relative to stepped portion 36*b*, and/or stepped portion 36*b* can comprise a smaller radius relative to stepped portion 36*a*, to facilitate the engagement of lid 40 with container 30 (FIGS. 1, 2, 5 and 7). A lid-engagement structure 170 can be positioned on lid-receiving portion 36 (e.g., on stepped portion 36*b*) to engage with corresponding structure on lid 40. Lid-engagement structure 170 can comprise threads, slots, pins, grooves, and the like. In the illustrative embodiment, lid-engagement structure 170 comprises a first member 171 positioned on lid-receiving portion 36*b* to form a slot or gap 173 between stepped portion 36*a* and first member 171. A corresponding portion of lid 40 can be configured to engage with gap 173. In operation, lid 40 is placed over container 30, and moved (e.g., rotated) such that a portion of lid 40 is positioned within gap 173 and thus engages lid 40 with container 30. In some embodiments, lid-engagement structure 170 can comprise a second member 172 positioned on lid-receiving portion 36*b* to act as a stop during the engagement of lid 40 with container 30. It will be understood that lid-engagement structure 170 and member 171 can be used with or without second member 172, and member 171 can be oriented at a variety of angles with respect to the remainder of container 30 (e.g., stepped portion 36*b*). In some embodiments, member 171 can be positioned at an angle to form a vertex between member 171 and stepped portion 36*a*, wherein the vertex forms a stop between member 171 and stepped portion 36*a* during the engagement of lid 40 with container 30. It will be understood that container 30 can include more than one lid-engagement structures 170 spaced around the perimeter of lid-receiving portion 36. In some embodiments, container 30 can comprise four lid-engagement structures 170; e.g., at intervals of approximately 90 degrees around the perimeter of lid-receiving portion 36.

A powdered instant beverage can be packaged using embodiments of the apparatus described herein and shown in the figures, using various methods. In an embodiment, a powdered instant beverage can be packaged using the following steps: providing a first container 20 comprising a rim 24 extending around an opening 23 positioned at an upper end 21 of the first container 20; filling a second container 30 with a powdered instant beverage, the second container 30 comprising a sidewall 35 with a rim-engaging structure 37 extending outwardly therefrom; removably securing a utensil 50 to a lid 40; engaging the second container 30 with the lid 40 so that the lid 40 and the second container 30 enclose an interior volume; inserting a lower end 32 of the second container 30 into the opening 23 of the first container 20 such that the rim-engaging structure 37 of the second container 30 contacts the rim 24 of the first container 20; engaging a first securing strip 60, 61, 62, 63 with at least two of the second container 30, the first container 20 and the lid 40 when the lower end 32 of the second container 30 is inserted into the opening 23 of the first container 20 and the rim-engaging structure 37 rests upon the rim 24.

In some embodiments, the inserting step can comprise inserting the lower end 32 of the second container 30 into the opening 23 positioned at the upper end 21 of the first container 20 such that a portion 38 of the second container 30 extends above the rim 24 when the rim-engaging structure 37 contacts the rim 24.

In some embodiments, the method of packaging can further comprise sealing the open upper end 31 of the second container 30 with a removable membrane 80.

In some embodiments, engaging the first securing strip 60 further comprises sealing said at least two of the second container 30, the first container 20 and the lid 40 to each other.

In some embodiments, the method of packaging can further comprise forming a loop around the at least two of the second container 30, the first container 20 and the lid 40 with the strip 62, 63.

In some embodiments, removably securing can comprise removably securing the utensil 50 to the lid 40 with a magnetic force.

In some embodiments, removably securing comprises positioning a handle of the utensil 50 between a pair of holding members 48 extending from a surface of the lid 40.

In some embodiments, the method further comprises printing product information on the first securing strip.

In some embodiments, the method further comprises engaging a second securing strip with at least two of the second container 30, the first container 20 and the lid 40, wherein the at least two of the first container 20, the second container 30 and the lid 40 engaged by the first strip is non-identical to the at least two of the first container 20, the second container 30 and the lid 40 engaged by the second strip.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments. In addition, reference to "one embodiment," "another embodiment," etc. is not generally intended to imply that embodiments described herein are separate and distinct, and/or mutually exclusive of one another. Thus, embodiments described herein may contain common elements, features and/or steps.

It should be emphasized that many variations and modifications may be made to the above-described embodiments, the elements of which are to be understood as being among other acceptable examples. All such modifications and variations are intended to be included herein within the scope of this disclosure and protected by the following claims.

What is claimed is:

1. A package for storing a powdered instant beverage, comprising:

a first container;

a utensil;

a lid configured to engage the first container so that the lid and the container enclose an interior volume, wherein the lid comprises:

a lid body;

a lid insert configured to be secured to a lower side of the lid body, the lid insert comprising a utensil recess that extends upwardly into a central portion of a lower surface of the lid insert, the utensil recess configured to receive at least a portion of the utensil from below the lower surface, and a handling recess configured to facilitate the removal and securing of the utensil to the lid; and a utensil-holding structure on the lid insert, the utensil-holding structure configured to removably secure the utensil to the lid insert; and a second container, the second container comprising a rim extending around an opening positioned at an upper end of the second container;

wherein the first container has an upper end and a lower end, the upper end including a lid-receiving portion around which the lid can engage, the lower end configured to be inserted into the opening of the second container, the first container comprising a rim-engaging structure extending outwardly from a sidewall of the first container and below the lid-receiving portion, wherein an inner width or diameter of the lid-receiving portion is less than an outer width or diameter of the rim-engaging structure, the rim-engaging structure configured to contact and rest upon the rim when the lower end of the first container is inserted into the opening of the second container.

2. The package of claim 1, further comprising a removable membrane configured to seal an upper end of the first container.

3. The package of claim 1, wherein the at least a portion of the utensil comprises a material-receiving portion of said utensil.

4. The package of claim 1, wherein the utensil comprises a spoon.

5. The package of claim 1, wherein the utensil comprises a first member slidably engaged with a second member, the first member and the second member configured to lengthen or shorten a length of the utensil when moved relative to each other.

6. The package of claim 1, wherein the utensil-holding structure comprises a magnet.

7. The package of claim 1, wherein the utensil-holding structure comprises a pair of holding members extending from a surface of the lid insert, the holding members configured to engage opposing edges of a handle of the utensil to secure the utensil to the lid insert when the handle is positioned between the holding members.

8. The package of claim 1, further comprising a securing strip configured to engage with at least two of the first container, the second container and the lid when the lower end of the first container is inserted into the opening of the second container and the rim-engaging structure rests upon the rim.

9. The package of claim 1, wherein the utensil comprises a material-engagement portion and a handle, the utensil recess comprising a material-engagement recess and a handle recess, the material-engagement recess configured to receive the material-engagement portion of the utensil, the handle recess configured to receive the handle of the utensil, and wherein the handling recess comprises a pair of fingertip recesses extending on opposing sides of the handle when the material-engagement portion is received within the material-engagement recess and the handle is received within the handle recess, each of the fingertip recesses configured to accommodate a user's fingertips while disengaging or securing the utensil with respect to the lid insert.

10. The package of claim 1, wherein the utensil comprises a material-engagement portion and a handle, the utensil recess comprising a material-engagement recess and a handle recess extending into a surface of the lid insert, the material-engagement recess configured to receive the material-engagement portion of the utensil, the handle recess configured to receive the handle of the utensil, the material-engagement recess extending into a surface of the lid insert substantially deeper than the handle recess.

11. The package of claim 1, wherein the utensil recess is configured to receive the at least a portion of the utensil such that the at least a portion of the utensil is flush with a lower surface of the lid insert.

12. The package of claim 1, wherein the utensil can be removably secured to the lid insert in at least two orientations, including a first orientation in which a side of the utensil faces downward, and a second orientation in which the side of the utensil faces upward.

13. A package for storing and serving a powdered instant beverage, comprising:

a first container comprising a rim extending around an opening positioned at an upper end of the first container;

a second container having an upper end and a lower end, the upper end including a lid-receiving portion, the lower end configured to be inserted into the opening of the first container, the second container comprising a rim-engaging structure extending outwardly from a sidewall of the second container and below the lid-receiving portion, wherein an inner width or diameter of the lid-receiving portion is less than an outer width or diameter of the rim-engaging structure, the rim-engaging structure configured to contact and rest upon the rim when the lower end of the second container is inserted into the opening of the first container;

a lid configured to engage the second container around the lid-receiving portion so that the lid and the second container enclose an interior volume;

a utensil, wherein at least one of the lid and the utensil comprises a utensil-holding structure configured to removably secure the utensil to the lid; and a securing strip configured to engage with at least two of the first container, the second container and the lid when the lower end of the second container is inserted into the opening of the first container and the rim-engaging structure rests upon the rim.

14. The package of claim 13, wherein a portion of the second container extends above the rim when the rim-engaging structure contacts and rests upon the rim.

15. The package of claim 13, wherein the lid comprises a lid body and a lid insert configured to be secured to a lower side of the lid body, the lid insert comprising a utensil recess that extends upwardly into a central portion of a lower surface of the lid insert, the utensil recess configured to receive at least a portion of the utensil from below the lower surface, wherein the utensil-holding structure is on the insert.

16. The package of claim 15, wherein the at least a portion of the utensil comprises a material-receiving portion of said utensil.

17. The package of claim 15, wherein the lid insert further comprises a handling recess configured to facilitate the removal and securing of the utensil to the lid.

18. The package of claim 13, wherein the lid comprises:

a utensil recess configured to receive a portion of the utensil; and a handling recess configured to facilitate the removal and securing of the utensil to the lid.

19. The package of claim 13, wherein the securing strip is configured to seal the at least two of the first container, the second container and the lid to each other.

20. The package of claim 15, wherein the securing strip comprises a tamper-evident or tamper-resistant seal.

21. The package of claim 13, wherein the securing strip comprises an adhesive strip.

22. The package of claim 13, wherein the securing strip includes product indicia of the package.

23. The package of claim 13, wherein the securing strip comprises a loop configured to wrap around the at least two of the first container, the second container and the lid.

24. The package of claim 13, wherein the securing strip comprises a first securing strip, the package further comprising a second securing strip configured to engage at least two of the first container, the second container and the lid, wherein the at least two of the first container, the second container and the lid engaged by the first strip is non-identical to the at least two of the first container, the second container and the lid engaged by the second strip.

25. The package of claim 13, wherein the utensil comprises a spoon.

26. The package of claim 13, wherein the utensil comprises a first member slidably engaged with a second member, the first member and the second member configured to lengthen or shorten a length of the utensil when moved relative to each other.

27. The package of claim 13, wherein the utensil-holding structure comprises a magnet.

28. The package of claim 13, wherein the utensil-holding structure comprises a pair of holding members extending from a surface of the lid, the holding members configured to receive and secure a handle of the utensil when the handle is positioned between the holding members.

29. The package of claim 13, wherein at least one of the first container or second container comprises an inverted frustroconical shape.

30. The package of claim 13, further comprising a removable membrane configured to seal an upper end of the second container.

31. The package of claim 13, further comprising an annular flange extending outwardly from a sidewall of the lid, the annular flange adjacent to the rim-engaging structure when the lid engages the second container.

32. A method of packaging a powdered instant beverage, comprising:

providing a first container comprising a rim extending around an opening positioned at an upper end of the first container;

filling a second container with a powdered instant beverage, the second container comprising:

an upper end with a lid-receiving portion;

a lower end;

a sidewall; and a rim-engaging structure extending outwardly from the sidewall and below the lid-receiving portion;

removably securing a utensil to a lid;

engaging the second container with the lid around the lid-receiving portion so that the lid and the second container enclose an interior volume;

inserting a lower end of the second container into the opening of the first container such that the rim-engaging structure of the second container contacts the rim of the first container; and engaging a securing strip with at least two of the first container, the second container and the lid when the lower end of the second container is inserted into the opening of the first container and the rim-engaging structure rests upon the rim.

33. The method of claim 32, wherein inserting comprises inserting the lower end of the second container into the opening positioned at the upper end of the first container such that a portion of the second container extends above the rim when the rim-engaging structure contacts the rim.

34. The method of claim 32, further comprising sealing the open upper end of the second container with a removable membrane.

35. The method of claim 32, wherein engaging the securing strip further comprises sealing the at least two of the second container, the first container and the lid to each other.

36. The method of claim 32, further comprising forming a loop around the at least two of the second container, the first container and the lid with the strip.

37. The method of claim 32, wherein removably securing comprises removably securing the utensil to the lid with a magnetic force.

38. The method of claim 32, wherein removably securing comprises positioning a handle of the utensil between a pair of holding members extending from a surface of the lid.

39. The method of claim 32, further comprising printing product information on the securing strip.

40. The method of claim 32, wherein the securing strip comprises a first securing strip, the package further comprising engaging a second securing strip with at least two of the second container, the first container and the lid, wherein the at least two of the first container, the second container and the lid engaged by the first strip is non-identical to the at least two of the first container, the second container and the lid engaged by the second strip.

41. A package for storing and serving a powdered instant beverage, comprising:

a first container with an open upper end, the first container comprising an upper portion and a lower portion;

a second container having a lower portion configured to be inserted into the open upper end of the first container, the upper portion of the first container being sized and shaped to receive the lower portion of the second container, the lower portion of the first container being sized and shaped to inhibit insertion of the lower portion of the second container into the lower portion of the first container, such that the second container can rest within and upon the first container when the lower portion of the second container is inserted into the upper portion of the first container;

a lid configured to engage an open upper end of the second container so that the lid and the second container enclose an interior space;

a utensil, wherein at least one of the lid and the utensil comprises a utensil-holding structure configured to removably hold the utensil to the lid; and a securing strip configured to engage with at least two of the first container, the second container and the lid when the lower portion of the second container is inserted into the upper portion of the first container and the second container rests within and upon the first container.

42. The package of claim 41, wherein the upper portion of the first container comprises a first inner surface, and the lower portion of the first container comprises a second inner surface, the second inner surface positioned relative to the first inner surface to form an edge stop between the first inner surface and the second inner surface, wherein the edge stop inhibits insertion of the lower portion of the second container into the lower portion of the first container.

* * * * *